US012203244B2

(12) United States Patent
Hamilton

(10) Patent No.: US 12,203,244 B2
(45) Date of Patent: Jan. 21, 2025

(54) APPARATUS, METHODS, AND SYSTEMS OF MONITORING THE CONDITION OF A WEAR COMPONENT

(71) Applicant: ACTIVE CORE TECHNOLOGY PTY LTD, Balcatta (AU)

(72) Inventor: Ian Hugh Hamilton, Cottesloe (AU)

(73) Assignee: ACTIVE CORE TECHNOLOGY PTY LTD, Balcatta (AU)

( * ) Notice: Subject to any disclaimer, the term of this patent is extended or adjusted under 35 U.S.C. 154(b) by 263 days.

(21) Appl. No.: 17/634,457

(22) PCT Filed: Aug. 9, 2020

(86) PCT No.: PCT/AU2020/050825

§ 371 (c)(1),
(2) Date: Feb. 10, 2022

(87) PCT Pub. No.: WO2021/026597

PCT Pub. Date: Feb. 18, 2021

(65) Prior Publication Data

US 2022/0275607 A1 Sep. 1, 2022

(30) Foreign Application Priority Data

| | | |
|---|---|---|
| Aug. 10, 2019 | (AU) | 2019902878 |
| Aug. 10, 2019 | (AU) | 2019902879 |
| Sep. 10, 2019 | (AU) | 2019903345 |

(51) Int. Cl.
*E02F 9/26* (2006.01)
*E02F 9/28* (2006.01)

(52) U.S. Cl.
CPC ..... *E02F 9/267* (2013.01); *E02F 9/2808* (2013.01); *E02F 9/2883* (2013.01)

(58) Field of Classification Search
None
See application file for complete search history.

(56) References Cited

U.S. PATENT DOCUMENTS

| | | | |
|---|---|---|---|
| 3,062,302 | A | 11/1962 | Toth |
| 4,174,014 | A | 11/1979 | Bjorksten |

(Continued)

FOREIGN PATENT DOCUMENTS

| | | | | |
|---|---|---|---|---|
| CN | 107849836 | A | 3/2018 | |
| WO | WO-0106207 | A1 * | 1/2001 | ..... B02C 15/004 |

(Continued)

OTHER PUBLICATIONS

Patent Cooperation Treaty: International Search Report and Written Opinion for PCT/AU2020/050825 dated Nov. 24, 2020; 19 pages.

*Primary Examiner* — Peter J Macchiarolo
*Assistant Examiner* — Jermaine L Jenkins
(74) *Attorney, Agent, or Firm* — Schwabe, Williamson & Wyatt, P.C.

(57) ABSTRACT

Apparatus, methods, and systems of monitoring the condition of a wear component, including a sensor system for monitoring the condition of a wear component comprising: an outer casing bottom portion having a closed bottom end; at least one battery situated inside the outer casing bottom portion; at least one cushioning element interposed between the at least one battery and at least one sensor component; at least one metal disc antenna positioned at a distance above the at least one sensor component; at least one metal connector element configured to join the metal disc antenna to the sensor component; and an outer casing top portion adapted to fit over at least the metal disc antenna, wherein the outer casing top portion is adapted to substantially connect with the outer casing bottom portion.

20 Claims, 10 Drawing Sheets

(56) References Cited

U.S. PATENT DOCUMENTS

| | | | | |
|---|---|---|---|---|
| 6,712,160 | B1 | 3/2004 | Schultz | |
| 10,011,975 | B2 * | 7/2018 | Carpenter | E02F 9/2825 |
| 11,773,570 | B2 * | 10/2023 | Hyde | G01V 3/081 37/456 |
| 2008/0028644 | A1 * | 2/2008 | Lopez Almendros | E02F 9/2825 37/457 |
| 2016/0178483 | A1 | 6/2016 | Sidles | |
| 2016/0237657 | A1 | 8/2016 | Carpenter | |
| 2018/0217108 | A1 | 8/2018 | Plouzek | |
| 2019/0153703 | A1 | 5/2019 | Hyde | |
| 2020/0088617 | A1 * | 3/2020 | Marquez Llinas | E02F 9/2816 |

FOREIGN PATENT DOCUMENTS

| | | | |
|---|---|---|---|
| WO | 2012/116408 | A1 | 9/2012 |
| WO | 2018/095536 | A1 | 5/2018 |

* cited by examiner

APPARATUS, METHODS, AND SYSTEMS OF MONITORING THE CONDITION OF A WEAR COMPONENT

CROSS-REFERENCE TO RELATED APPLICATION

The present application is a national phase entry under 35 U.S.C. § 371 of International Application No. PCT/AU2020/050825, filed Aug. 9, 2020, which designates the United States of America, which claims priority to AU Application No. 2019902878, filed Aug. 10, 2019, AU Application No. 2019902879, filed Aug. 10, 2019 and AU Application No. 2019903345, filed Sep. 10, 2019, the entire disclosures of each of these applications are hereby incorporated by reference in their entireties and for all purposes.

TECHNICAL FIELD

The present invention relates generally to monitoring systems and, more particularly, to monitoring systems for determining the condition of ground engaging tool components and took. Although the present invention will be described with particular reference to determining the condition of ground engaging tool components on mining or earthmoving machinery, it will be appreciated that the invention is not necessarily limited to this application.

BACKGROUND

During operation, all earthmoving or excavating mining machinery are subject to heavy impact and abrasion on the surfaces of the machinery that are in direct contact with the ground. To avoid having to constantly replace or refurbish the entire machinery, earthmoving or excavating mining machinery (such as, for example, face shovels, draglines, front end loaders and excavators) are usually fitted with replaceable Ground Engaging Tools (GETs) that are designed to absorb most of this direct impact on the parts of the machinery that are subject to the most amount of wear (typically at or around the digging edge of the bucket on earthmoving or excavating mining machinery). This way, the majority of the wearing on the machinery occurs on the GETs and so the earthmoving or excavating mining machinery can be easily refurbished by simply replacing the GETs.

There are essentially two types of GETs that are used on the buckets of earthmoving or excavating mining machinery. The first type of GET is designed to break up the ground and typically takes the form of a series of pointed protrusions or 'teeth' that extend out from the digging edges of the earthmoving or excavating mining machinery. In some earthmoving or excavating mining machinery, the teeth are directly welded onto or cast as part of the digging edge of the bucket. In other systems, these types of GETs are mechanically attached to the digging edge of the bucket, often through the use of another component commonly known as an 'adapter'. As these GETs are directly responsible for digging into and breaking up the ground, they are subject to much greater impact (and therefore, much greater wear) than the parts of the digging edge in between the teeth.

Another type of GET, more commonly known as a 'shroud', protects the digging edge of the bucket between the teeth of the earthmoving or excavating mining machinery. Like adapters and teeth, shrouds are either directly welded or cast onto the digging edge, or otherwise mechanically attached to the bucket lip. As shrouds are not directly responsible for digging into the ground, they are subject to less wearing than teeth.

During excavating and earthmoving operations, the wear components on GET hardware (especially the teeth) experience gradual wearing and require periodic replacement in order to maintain efficient digging operations and to protect the bucket (and adapters, if used) from damage. As the GET wear components wear down, the penetration of the cutting edge reduces and the energy required to dig the same amount of material increases. As a result, determining when the GET wear components are nearing the end of their useful life and knowing the optimum time to undertake their replacement is very important.

Excavating and earthmoving machines typically require a number of GET wear components along the bottom and side edges of the bucket. In the context of a mining operation, where 'downtime' can be a significant expense to the business, determining when (and how often) to inspect and replace the GET wear components is of valuable importance. Changing the GET wear components (e.g. teeth) too early can mean an additional expense to the business as the useful life of those component is not being realised. Whereas, changing the GET wear components too late can expose the bucket (and adapters on the bucket) of the excavating machine to damage. Unlike GET wear components, the bucket of an excavating machine is not designed as a regular (i.e. sacrificial) wear component and therefore 'downtime' to repair or replace a bucket can be significant and costly to a continuous mining operation.

In other instances, the teeth and adapters can break and fall off during the dig and load cycle of the excavating operation and, as a result, "contaminate" the ore. GET components are typically made of hardened alloy steel and can weigh up to hundreds of kilograms, making them one of the worst tramp metal hazards in a mining operation, particularly in the downstream processing operations. They have the potential to create significant work place hazards, which can result in significant production losses through equipment damage, plant downtime and/or ore wastage.

Typically, if a breakage of a GET component is detected, the earthmoving or excavating mining machinery (including the associated haulage trucks) immediately cease production and the digging face is inspected. If the missing GET component (or fragment of that GET) cannot be readily found, several scoops of ore (in the context of a mining operation) are removed from the suspected location and all outbound haulage trucks carrying ore are re-routed to dump their loads in a "quarantine" stockpile area.

However, if a broken GET component is not detected or found within a relatively short period of time after breakage, there is a more significant risk that the broken GET or GET fragment may be delivered to the ore crusher, which is not designed to process such hard materials and which will commonly suffer significant (often catastrophic) mechanical damage if it attempts to process (i.e. crush) the GET or GET fragment. For example, one of the GET teeth, if broken free from the bucket of the earthmoving or excavating mining machinery, has the potential to jam the crusher causing severe damage and putting the crusher out of service and operation for hours or days at a time (depending on the degree of mechanical damage).

Further, the process of removing a jammed GET tooth or broken GET fragment from a crusher is a very dangerous procedure that can result in human injuries or even fatalities if not performed properly. A GET tooth or fragment that inadvertently enters a crusher also has the potential to be projected out at great speed due to the significant mechanical forces applied to it by, for example, the jaws of the crusher, which in turn poses significant dangers for nearby personnel and equipment.

An earthmoving or excavating mining machine that continues to operate with missing, broken, or fully worn GET wear components can significantly increase the risk of breakages or accelerated wearing/damage to other parts of the machine (for example, the bucket lip of a shovel) resulting in expensive equipment repairs and extended downtime.

Replacement of worn GET wear components (i.e. GET wear components worn beyond their useful life) relies on an efficient method for determining the level of wear and timing for replacement. Similarly, broken or detached GET components are a serious safety issue, and when combined with energy wastage, production losses, and equipment damage, they represent a significant operational cost to the global mining industry every year. The total cost of this problem to the global mining industry could be measured in billions of dollars per annum, when considering both direct and indirect costs. Existing methods for determining the condition and replacement timing for wear components have been primarily based on two approaches. The most widely employed method is the visual confirmation method. However, it is a system that is highly susceptible to 'human error' and, as a result, is not considered an effective solution.

Another method that has been used in the mining industry for monitoring the condition of wear components involves the use of callipers or a frame to check the level of wear of a wear component against a measurement tool. This system is not universally used in the mining industry as it is specific to the GET wear component in use and it is common for mining operations to use different designs of GET across their fleet of excavating and earthmoving machines.

It is against this background that the present invention has been developed.

In this specification where a document, act or item of knowledge is referred to or discussed, this reference or discussion is not an admission that the document, act or item of knowledge or any combination thereof was at the priority date, publicly available, known to the public, part of the common general knowledge; or known to be relevant to an attempt to solve any problem with which this specification is concerned.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

The present disclosure relates to a sensor system for monitoring the condition of a wear component comprising:

an outer casing bottom portion having a closed bottom end;

at least one battery situated inside the outer casing bottom portion;

at least one cushioning element interposed between the at least one battery and at least one sensor component;

at least one metal disc antenna positioned at a distance above the at least one sensor component;

at least one metal connector element configured to join the metal disc antenna to the sensor component; and an outer casing top portion adapted to fit over at least the metal disc antenna, wherein the outer casing top portion is adapted to substantially connect with the outer casing bottom portion.

At least one of the outer casing top portion or the outer casing bottom portion may be substantially transparent to radio frequency electromagnetic signals. More preferably, at least one of the outer casing top portion or the outer casing bottom portion may be comprised of plastic. Still more preferably, at least one of the outer casing top portion or the outer casing bottom portion may be comprised of polyetherimide plastic.

The sensor system may further comprise a silicone rubber layer on the bottom surface of the outer casing bottom portion.

The at least one battery may comprise a lithium cell battery. More preferably, the at least one battery may comprise a lithium cell coin battery, wherein the diameter of the lithium cell coin battery substantially meets an inside diameter of the outer casing bottom portion.

The at least one cushioning element may be comprised of a low-density foam.

The at least one sensor component may comprise at least one printed circuit board and at least one temperature sensor. Alternatively, the at least one sensor component may comprise at least one printed circuit board, at least one temperature sensor, and at least one accelerometer. Alternatively, the at least one sensor component comprises at least one printed circuit board, at least one temperature sensor, and at least one MEMS accelerometer. The at least one sensor component may comprise at least one magnetometer, at least one capacitive sensor, at least one piezoelectric microphone, or at least one MEMS piezo microphone.

The at least one metal disc antenna may be comprised of a copper beryllium alloy. Similarly, the at least one metal connector element may be comprised of a copper beryllium alloy. The at least one metal connector element may further comprise an extension of a portion of the at least one metal disc antenna.

The sensor system may further comprise a remote radio frequency receiver operable to receive sensor data wirelessly from the at least one sensor component.

In a particularly preferred embodiment of the present disclosure, the sensor system may be adapted to fit into at least one recess in at least one ground engaging tool portion. The at least one recess may be positioned such that the recess is proximate to at least one adapter for supporting the at least one ground engaging tool portion when the at least one adapter and the at least one ground engaging tool are connected. Further, the at least one recess may be positioned such that the recess opens into an internal cavity of the ground engaging tool portion, and such that the recess is substantially centrally located within the ground engaging tool portion. This centralised location is beneficial as it enables the sensor system to detect an average temperature indication of the thermal mass of the ground engaging tool portion. The at least one ground engaging tool may be a tooth, a lip shroud, or a side bar.

The present disclosure also relates to a ground engaging tool condition monitoring system comprising:

at least one impact-resistant sensor assembly including at least a temperature sensor, an accelerometer, a radio frequency antenna, and a battery;

a radio frequency receiver operable to receive sensor data wirelessly from the at least one impact-resistant sensor assembly;

and wherein the radio frequency receiver is configured to quantify at least one of a degree of wear or a wear rate in at least one ground engaging tool portion, the radio frequency receiver further configured to output at least one of ground engaging tool condition data or at least one notification or alarm based on ground engaging tool condition data.

The radio frequency receiver may be configured with onboard computing capability such that it can directly quantify the at least one of a degree of wear or a wear rate in at least one ground engaging tool portion. In an alternative embodiment of the present disclosure, the radio frequency receiver may communicate the sensor data to a remote computing device, via a data network, to quantify the at least one of a degree of wear or a wear rate in at least one ground engaging tool portion, and receive back from the remote computing device the quantified degree of wear or wear rate.

The at least one impact-resistant sensor assembly may comprise the sensor system of the above disclosure. The at least one impact-resistant sensor assembly may be functional in operating temperatures between −40 to +170 Degrees Celsius. Further, the at least one impact-resistant sensor assembly may be functional under average G-Forces of up to 8 g.

The present disclosure also relates to a ground engaging tool condition monitoring method comprising:

receiving an indication of radio frequency sensor data from at least one impact-resistant sensor that is positioned within at least one ground engaging tool portion, the radio frequency sensor data including at least temperature and accelerometer data;

processing the radio frequency sensor data to calculate ground engaging tool condition data, in cluding at least one of calculating at least one degree of wear or calculating at least one wear rate in the at least one ground engaging tool portion; and presenting an indication of at least one of the ground engaging tool condition data, or at least one notification or alarm based on the ground engaging tool condition data.

The present disclosure also relates to a ground engaging tool condition monitoring method comprising:

receiving an indication of radio frequency sensor data from at least one impact-resistant sensor that is positioned within at least one ground engaging tool portion, the radio frequency sensor data including at least accelerometer data;

processing the radio frequency sensor data to calculate ground engaging tool condition data, including an indication of attachment of the ground engaging tool portion; and presenting an indication of at least one of the ground engaging tool condition data, or at least one notification or alarm based on the ground engaging tool condition data.

The radio frequency sensor data may be received from the sensor system of the above disclosure.

The at least one degree of wear may indicate at least one of a desired state of wear or an undesirable state of wear. Further, the at least one degree of wear may indicate a temperature rate of rise (RoR) indicative of a worn ground engaging tool performance. Alternatively, the at least one degree of wear may indicate a temperature rate of fall (RoF) and/or a temperature Rate of Change (RoC) indicative of a worn ground engaging tool performance. Alternatively, or in addition, the at least one degree of wear may indicate a G-Force rate of rise (RoR) indicative of a worn ground engaging tool performance. Alternatively, or in addition, the at least one degree of wear may indicate an acoustic rate of rise (RoR) indicative of a worn ground engaging tool performance.

The indication of attachment of the ground engaging tool portion may indicate either attachment or detachment of the ground engaging tool portion.

Processing the radio frequency sensor data to calculate ground engaging tool condition data may include determining one or more of a temperature rate of rise, a temperature rate of fall, or temperature rate of change of the ground engaging tool based at least in part on the temperature data.

The ground engaging tool condition monitoring method may further comprise sending the indication of radio frequency sensor data from the at least one impact-resistant sensor that is positioned within the at least one ground engaging tool portion, the radio frequency sensor data including at least temperature and accelerometer data to a receiver.

The at least one temperature sensor may be able to detect variations in one or more thermal properties of a wear component the sensor system is embedded within. The one or more thermal properties of a wear component of the sensor system may be used to infer the degree of wear of the wear component the sensor system is embedded within. The one or more thermal properties of the wear component of the sensor system may be used to infer a % wear rate of the wear component.

The sensor system may further comprise a remote radio frequency receiver, wherein the remote radio frequency receives a sensed parameter detected by the sensor.

The at least one impact-resistant sensor assembly may be functional under average G-Forces of up to 8 g.

The at least one recess is positioned such that the recess is proximate to the at least one adapter when the at least one adapter and the at least one ground engaging tool are connected. The at least one recess is preferably positioned within the butt face (i.e. the internal face of the ground engaging tool portion that interfaces with an adapter on the bucket of excavating machine) of the at least one ground engaging tool portion in a central location. The central positioning of the recess (and the at least one impact resistant sensor) within the at least one ground engaging tool portion is advantageous for providing average temperature data for the thermal mass of the at least one ground engaging tool portion. The at least one impact-resistant sensor assembly may also be functional in operating temperatures between −40 to +170 Degrees Celsius.

The present disclosure also relates to a computer program product comprising a non-transitory computer readable medium comprising at least instructions that when executed on a computer cause the computer to:

receive an indication of radio frequency sensor data from at least one impact-resistant sensor that is positioned within at least one ground engaging tool portion, the radio frequency sensor data including at least temperature and accelerometer data;

process the radio frequency sensor data to calculate ground engaging tool condition data, including at least one of calculating at least one degree of wear or calculating at least one wear rate in the at least one ground engaging tool portion; and present an indication of the ground engaging tool condition data, or at least one notification or alarm based on the ground engaging tool condition data.

The computer program product may further comprise instructions for pairing a radio frequency sensor to a receiver.

The presentation of the notification may further comprise instructions for activating one or more of an audible alert, a haptic alert, a visual alert, or a machine detectable alert.

The present disclosure also relates to a wireless sensor system for detecting a rate of rise characteristic of a material and broadcasting a rate of rise data comprising:

an outer casing bottom portion having a closed bottom end, and wherein the closed bottom end is within a metal structure;

at least one battery situated inside the outer casing bottom portion;

at least one cushioning element interposed between the at least one battery and at least one temperature sensor component, wherein the temperature sensor component detects temperature data of the metal structure;

at least one metal disc antenna positioned at a distance above the at least one temperature sensor component;

at least one resilient metal connector element configured to join the metal disc to the temperature sensor component wherein the at least one metal connector element substantially preserves a sensor to metal disc antenna gap; and an outer casing top portion adapted to fit over at least the metal disc antenna, wherein the outer casing top portion is adapted to substantially connect with the outer casing bottom portion.

The at least one resilient metal connector element may return the metal disc antenna to substantially an original sensor to metal disc antenna gap. Further, the sensor to metal disc antenna gap may be an air gap. The at least one resilient metal connector element may also return the metal disc antenna to substantially an original metal disc antenna to outer casing gap.

The at least one cushioning element may reduce a first impact force experienced by the at least one temperature sensor component and/or a second impact force experienced by the at least one battery.

The wireless sensor system may further comprise a remote wireless receiver for receiving temperature data of the metal structure. Additionally, the wireless sensor system may further comprise a data processor for processing the received temperature data of the metal structure. The data processor may infer a degree of wear of the metal structure based at least in part on the received temperature data of the metal structure.

The wireless sensor system may further comprise a user detectable alert, wherein the user detectable alert is triggered when the inferred degree of wear of the metal structure is an unacceptable degree of wear. The alert may be one or more of an audible alert, an audible alarm, a haptic alert, or a visual alert. The visual alert may be one or more of a blinking light, a displayed alert on an LCD monitor, a displayed alert on a wearable device, a displayed alert on a LED monitor, or a displayed alert on an OLED monitor. Further, the alert may be electronically communicative with the remote receiver.

The wireless sensor system may further comprise a user detectable alert, wherein the user detectable alert is triggered based on the received temperature data of the metal structure. Additionally, the wireless sensor system may further comprise a machine detectable alert, wherein the machine detectable alert is triggered when the inferred degree of wear of the metal structure is an unacceptable degree of wear. The machine detectable alert may be a stop instruction for disarming an operation of a mechanical device.

The mechanical device may be one of a heavy equipment device, an excavator, or a dozer.

The wireless sensor system may further comprise an inventory management system wherein the inventory management system maintains at least one record of the wireless sensor system. The inventory management system may be operable to replenish a physical inventory of a wireless sensor system inventory record by delivering at least one second wireless sensor system and/or at least one wear component based at least in part on either the wireless sensor system inventory record or the inferred degree of wear of the metal structure. The at least one record may contain one or more of: at least one instance of a pairing data of the wireless sensor system with the receiver, at least one instance of an inventory wherein the inventory includes at least a count of one or more wireless sensor systems and/or one or more wear components, at least one physical location wherein the at least one physical location includes at least one of a shipping address, a routing instruction, an electronic correspondence address, an email address, a phone number, and a billing address.

The at least one metal disc of the wireless sensor system may be mutually coupled to a metal structure by virtue of a symbiotic RF design between the wireless sensor system and the metal structure. The metal structure is preferably a Ground Engaging Tool (GET) component such as, for example, a tooth, a lip shroud, or a side bar.

The metal structure may have a mechanical profile or an RF profile approximately equivalent to a horn antenna or dish antenna.

The rate of rise (RoR) data may be one or more of a temperature rate of rise data, a temperature rate of fall data, a temperature rate of change data, a G-Force rate of rise data, and an acoustic rate of rise data.

An elastic property of the resilient metal connector element may be characterized by a spring constant.

BRIEF DESCRIPTION OF DRAWINGS

Embodiments of the present invention will now be described with reference to the accompanying drawings. These embodiments are given by way of illustration only and other embodiments of the invention are also possible. Consequently, the particularity of the accompanying drawings is not to be understood as superseding the generality of the preceding description. In the drawings.

DESCRIPTION OF EMBODIMENTS

Figure 1:
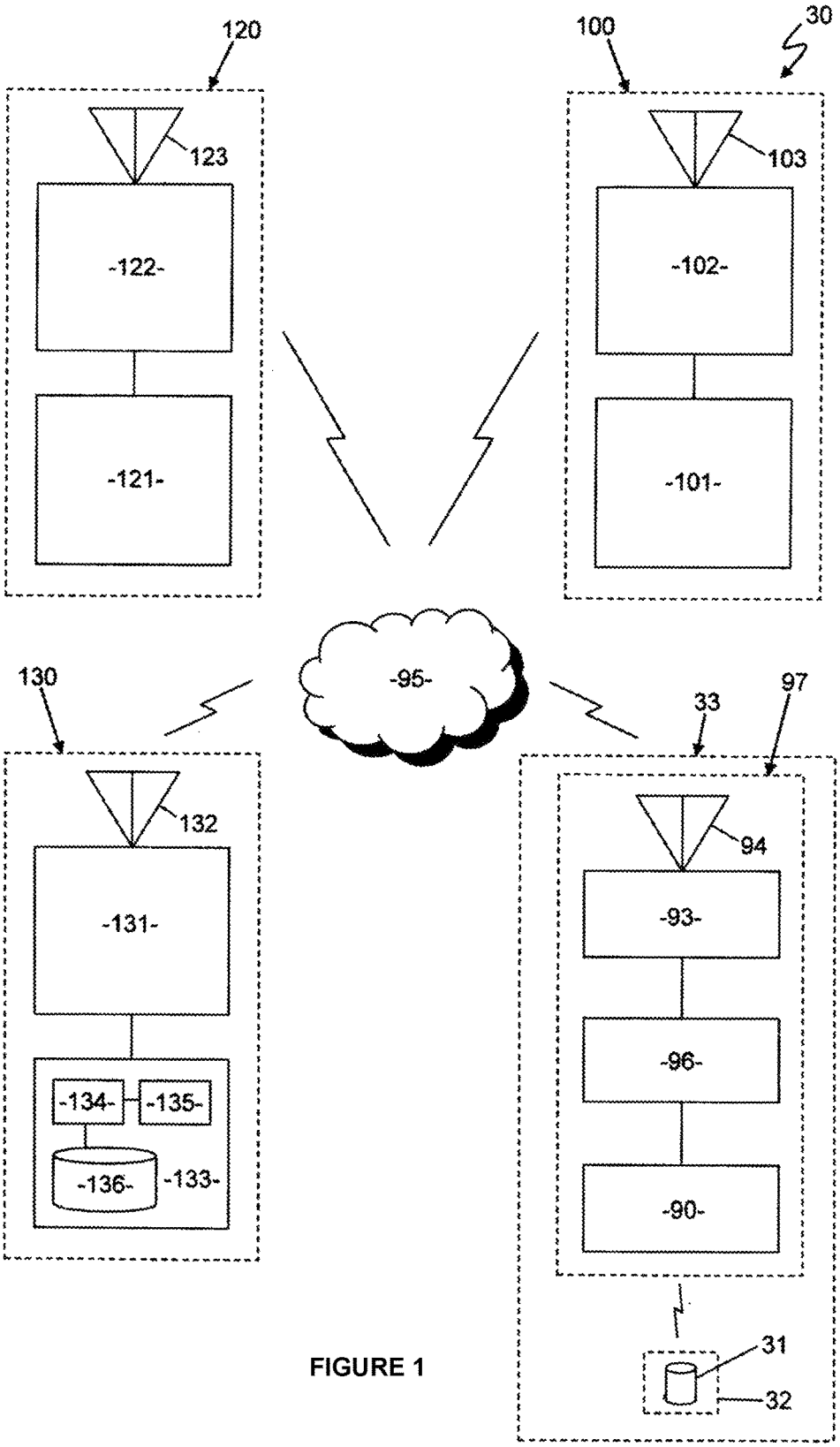
FIG. 1 is a schematic diagram illustrating a sensor system in accordance with a representative embodiment of the present disclosure.

Representative embodiments of the present disclosure relate, generally, to various apparatus, methods, and systems of monitoring the condition of a wear component and, more particularly, to monitoring systems for detecting the condition of ground engaging tool components and tools used on, for example, earthmoving or excavating mining machinery. The disclosure has particular, but not necessarily exclusive, application to monitoring systems for detecting the condition of ground engaging tool components from mining or earthmoving machinery. However, it should be understood that the disclosure is not limited to this representative embodiment, and may be implemented in other environments where similar earthmoving or excavation operations are conducted.

In accordance with the present disclosure, the monitoring of GET components on earthmoving or excavation machinery requires the sensing of data concerning the quality and/or performance of the GET component. However, due to the harsh environment in which earthmoving or excavation machinery typically operates, and the significant forces that impact the GET components during operation, there is a practical need to protect sensors from direct or indirect impacts that may damage or destroy these sensors. Positioning sensors in shielded locations such as, for example, within the internal cavities of either the tooth or adapter GET components is desirable due to the protection that this positioning affords. However, transmitting sensed data from within these metal structures is difficult to accomplish as the antenna used to broadcast sensed data often couples to the metal structure. This coupling causing the metal structure to behave as a Faraday Cage, impeding the propagation of the RF transmission to a remote receiver.

The present disclosure allows sensed data detected by a sensor embedded in a metal object (e.g. a GET component such as a tooth or adapter) to broadcast/transmit the sensed data to a remote receiver by exploiting the principle of coupling. Coupling, or mutual coupling, is a Radio Frequency term referring to an undesirable condition in which a first antenna within close proximity to a second antenna absorbs the energy being broadcast by the second antenna, thereby reducing the performance of the first antenna. Techniques described in the present disclosure allow the metal object (e.g. the GET component such as a tooth or adapter), in combination with a powered sensor and a metal disc antenna, to act as one mutually coupled and matched antenna for the transmission of sensed data to a remote receiver.

The present disclosure discusses, amongst other things, system parameters for delivering an impact resistant sensor system able to operate in difficult RF environments. For example, the present disclosure describes very small sensor systems that can be embedded within a metal object (e.g. a GET component such as a tooth or adapter) for the detection and broadcasting of physical and/or operational characteristics of the GET component (and the excavating or earthmoving machine that it is associated with). Small form factor, impact resistance, and transmission capabilities are particularly useful when visual detection of a physical characteristic, such as wear, is impractical.

FIG. 1 is a schematic diagram illustrating a sensor system 30 for monitoring the condition of a GET wear component.

Referring to FIG. 1, a sensor system 30 includes a plurality of sensor assemblies 31. Each sensor assembly 31 is mounted on a respective wear component 32 of a ground engaging tool (GET) of a mining or earthmoving machine 33 such that the sensor assembly 31 is secured to the wear component 32. The machine 33 may, for example, be a loader such as a front end loader, a shovel, or an excavator. Depending on what type of mining or earthmoving equipment the machine 33 actually is, the component 32 may, for example, be a tooth, adapter, protective plate, or a lip of a bucket or scoop. The sensor system 30 is able to detect the material characteristics (including for example, the gradual wearing, or complete loss) of the component 32 from the machine 33. The sensor system 30 is also able to detect/find/recover a lost component of the machine 33.

Figure 2:
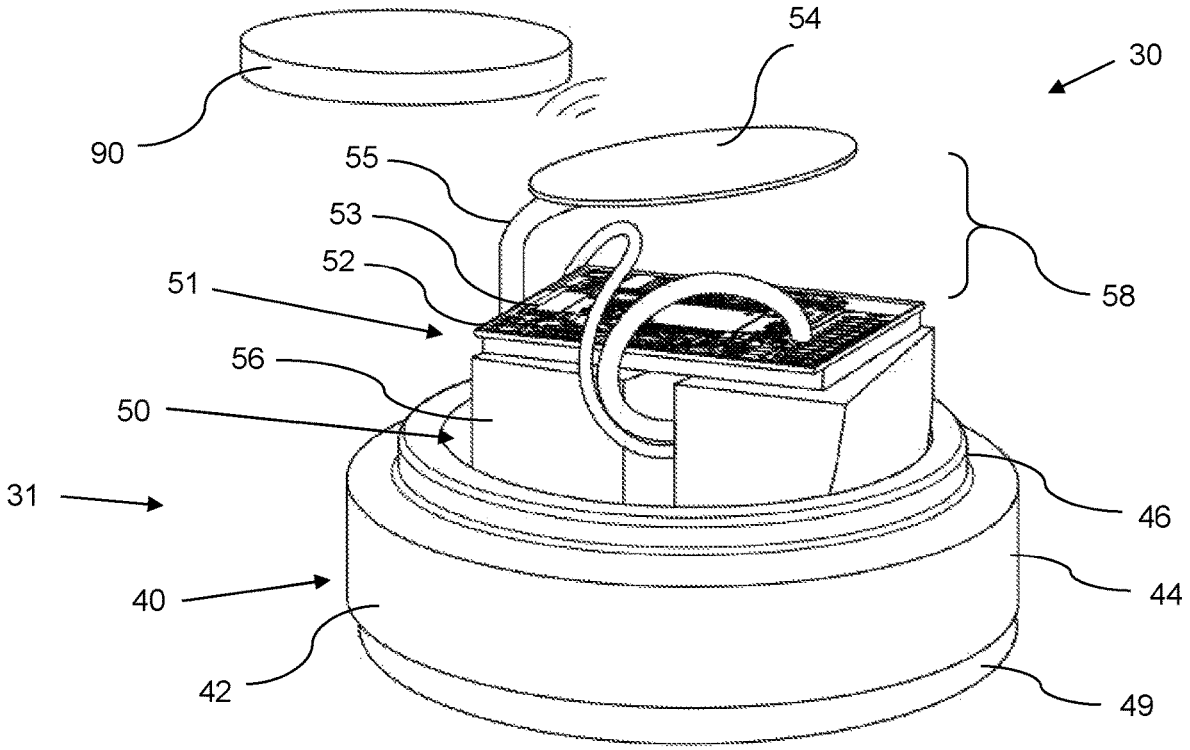
FIG. 2 is a partial view of a sensor assembly in accordance with a representative embodiment of the present disclosure.
Figure 3:
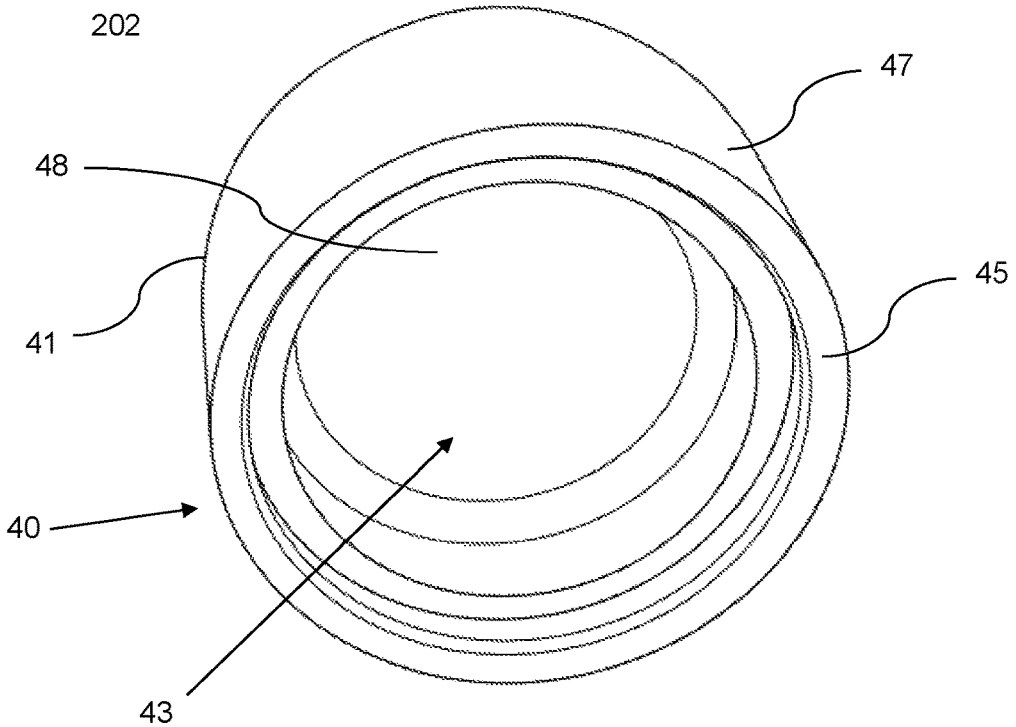
FIG. 3 is partial view of a sensor assembly, showing a cup of a cylindrical housing, in accordance with a representative embodiment of the present disclosure.
Figure 4:
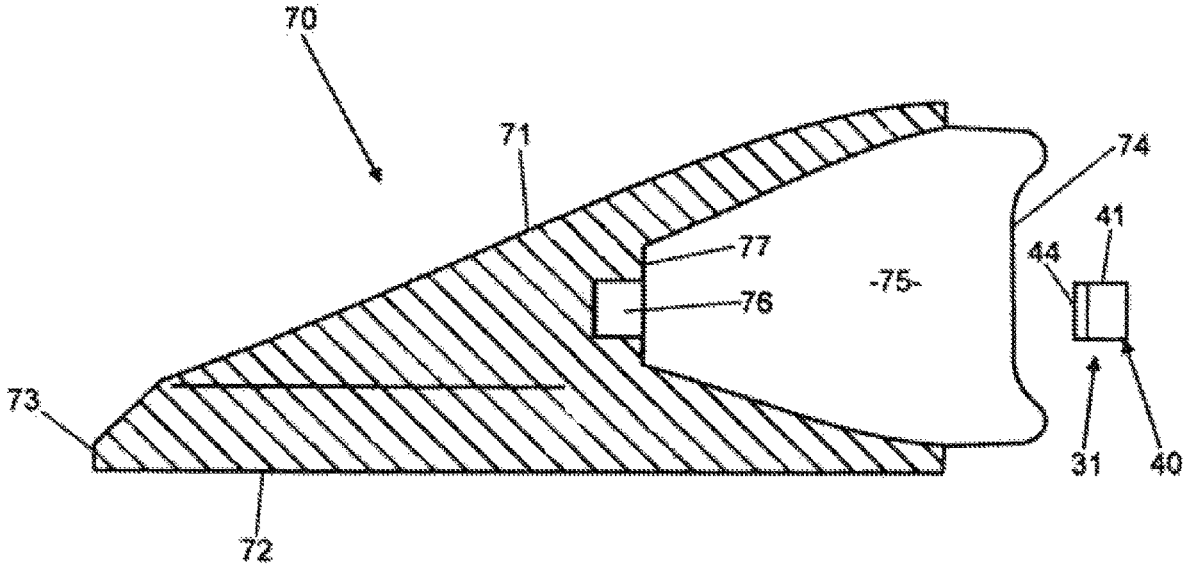
FIG. 4 is a cross-sectional side elevation of a tooth for a ground engaging tool and a sensor assembly prior to the sensor assembly being secured to the tooth.

According to a representative embodiment of the present disclosure, as shown in FIGS. 2 and 3 of the drawings, the sensor assembly 31 includes a protective cylindrical housing 40 (or outer casing). The cylindrical housing 40 includes a cylindrical cup 41 (or outer casing top portion), and a circular lid/end plug 42 (or outer casing bottom portion) with a closed bottom end for covering an opening 43 in an end of the cylindrical cup 41 and enclosing the space within the cylindrical housing 40.

Lid 42 includes an outer portion 44 for resting on a rim 45 of the cup 41 which surrounds the opening 43, and an inner portion 46 for inserting into the opening 43 when enclosing the space within the cylindrical housing 40. When inserted into the opening 43, the fit between the inner portion 46 of the lid 42 and the cup 41 is preferably a press fit. Alternatively, the interface between the inner portion 46 of the lid 42 and the cup 41 may include mating threads (not shown) and an internal bevel (not shown) to create a seal between the lid 42 and cup 41.

Alternatively, or in addition, the interface between the lid 42 and the cup 41 is sealed with a sealant such as, for example, a silicone sealant to prevent the ingress of undesirable materials (e.g. dust, liquid) into the space within the cylindrical housing 40.

The cup 41 of the cylindrical housing 40 includes a cylindrical side wall 47 which defines the opening 43 at the end of the cup 41 as well as the rim 45 of the cup 41. The opposing end of the cup 41 is preferably closed and comprises a base 48 from which the side wall 47 extends.

In a representative embodiment of the present disclosure, both the cup 41 and the lid 42 are made from a plastic material, such as polyetherimide plastic, that is substantially transparent to radio frequency electromagnetic signals. Synthetic polyetherimide polymers have numerous benefits in addition to their permissibility/transparency to RF, like their durability and manufacturing options like being able to be printed with a 3D printing device. Using a 3D printer with a suitable base material, like a synthetic polymer, may also allow the cup 41 and the lid 42 to be printed in a single step around the sensor assembly 31. A unified casing or shell made from a single bottom and top outer casing portion can be beneficial when additional water proofing is desired.

It should be appreciated that other materials, having similar properties (i.e. substantially transparent to radio frequency electromagnetic signals), may also be used and are envisaged within the scope of the present disclosure.

Alternatively, instead of 3D-printing the cup 41 and the lid 42, the protective housing 40 may be moulded, extruded or machined/turned to achieve the same overall structure.

In a representative embodiment of the present disclosure, the cylindrical housing 40 may also include a silicone rubber layer 49 that is adhered or bonded to a bottom surface of the lid 42. The silicone rubber layer 49 may preferably serve to dampen impact forces (e.g. forces transferred through the wear component 32) on the sensor assembly 31, and particularly the sensor component 51, during operation of the machine 33.

The sensor assembly 31 also includes a battery 50 that is situated inside the lid 42. As illustrated in FIG. 2 of the drawings, the battery 50 does not need to be fully contained within the lid 42 (or outer casing bottom portion), merely inside the circumference of the inner portion 46 of the lid 42 in order to allow the inner portion 46 to be inserted into the opening 43 of the cup 41. In a representative embodiment of the present disclosure, shown in FIG. 2 of the drawings, the battery is a lithium cell battery, preferably a lithium cell coin battery, having a diameter that substantially meets an inside diameter of the lid 42 (or outer casing bottom portion).

The sensor assembly 31 further comprises a sensor component 51 that includes a circuit board 52 on which various electronic components 53 are mounted. The circuit board 52 is adapted to be powered by the battery 50 that is connected to the circuit board 52 and that is also contained within the cylindrical housing 40. The circuit board 52 may include an epoxy resin coating (not shown) for additional protection from dust, fluid, and/or impact during operation. The electronic components 53 mounted to the circuit board 52 preferably include a temperature sensor, an accelerometer (for example, a MEMS accelerometer), a magnetometer, a capacitive sensor, a piezoelectric microphone, and/or a MEMS piezoelectric microphone. However, it should be appreciated that various combinations of one or more of these electronic components 53 are also envisaged by the present disclosure depending on the specific application of the sensor system 30.

The sensor assembly 31 further comprises a metal disc antenna 54 that is connected to the circuit board 52 of the sensor component 51, via a metal connector element 55, and positioned at a predetermined distance above the circuit board 52 of the sensor component 51. The metal disc antenna 54 can be made from a variety of metallic materials that have properties making them suitable for use as an RF antenna. In a representative embodiment of the present disclosure, the metal disc antenna 54 is made from a copper beryllium alloy. In a particularly preferred embodiment of the present disclosure, the metal disc antenna 54 and the metal connector element 55 are integrally formed from a single piece of metallic material. Such a configuration enables the metal disc antenna 54 to be positioned (and resiliently retained) at a predetermined distance above the circuit board 52 of the sensor component 51 without the need for additional apparatus.

The sensor assembly 31 further comprises a cushioning element 56 that is interposed between the battery 50 and the sensor component 51. The cushioning element 56 is adapted to dampen impact forces on the sensor assembly 31, and particularly the sensor component 51, during operation of the machine 33. In a representative embodiment of the present disclosure, the cushioning element 56 may be a low-density foam or similar impact dampening/adsorbing material. In a particularly preferred embodiment of the present disclosure, an adhesive (such as, for example, a silicone adhesive or bonding agent) may be used to bond the circuit board 52 of the sensor component 51 to the cushioning element 56, and/or to bond the cushioning element 56 to the battery 50. However, it should be appreciated that a variety of similar adhesives or bonding agents may be used based on the desired impact performance of the system 30.

It should be understood that when the cup 41 and lid 42 of the cylindrical housing 40 are brought into engagement (e.g. via a press fit, or other sealing mechanism), that the battery 50, sensor component 51, metal disc antenna 54, metal connector element 55, and cushioning element 56 are all enclosed within the cylindrical housing 40.

Figure 5:
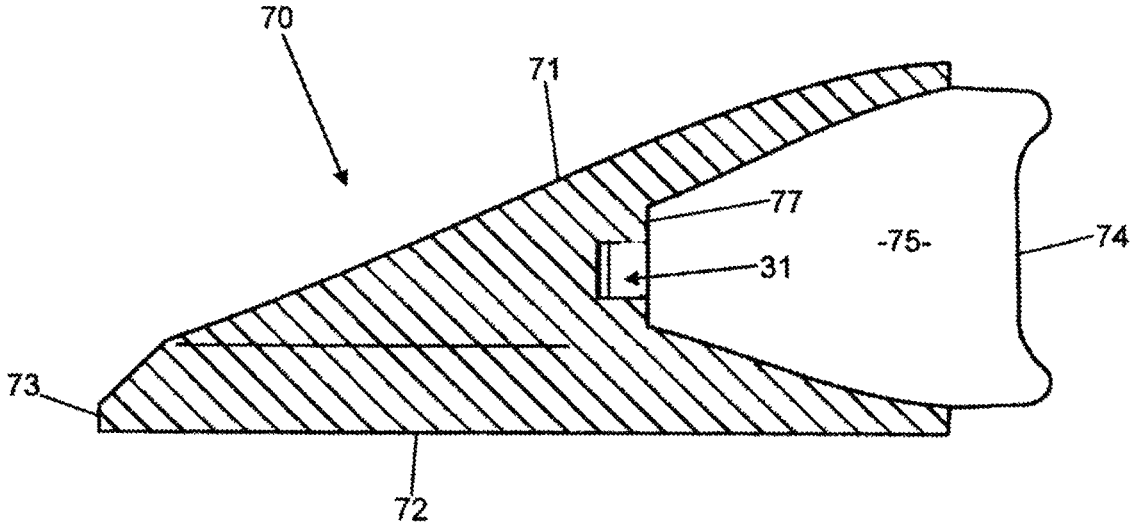
FIG. 5 is a cross-sectional side elevation of the tooth depicted in FIG. 4 after securing the sensor assembly to the tooth.
Figure 6:
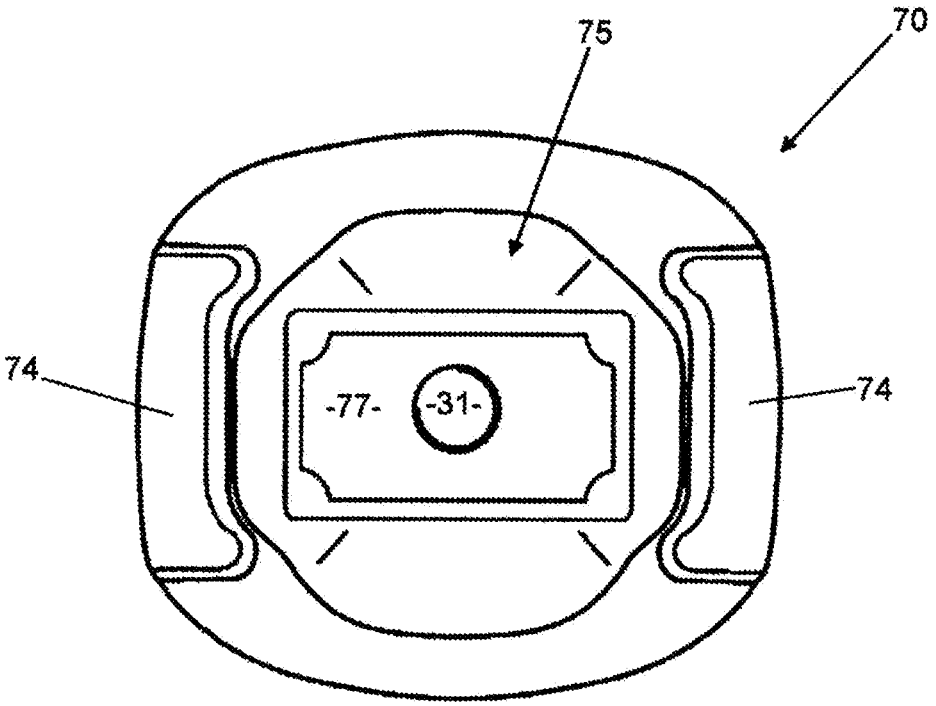
FIG. 6 is an end elevation of the tooth and sensor assembly depicted in FIG. 5.
Figure 7:
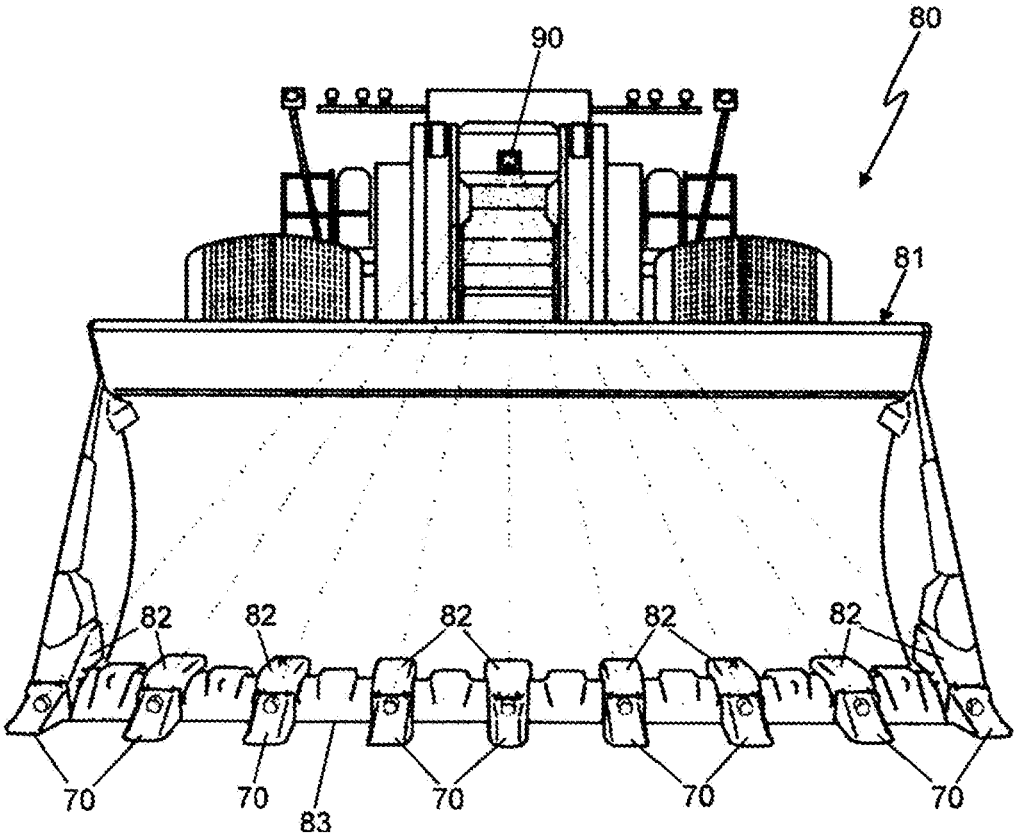
FIG. 7 is a front elevation of a front end loader machine that has a bucket on which is mounted a plurality of teeth of the type depicted in FIGS. 4, 5 and 6, and an sensor assembly reader for reading the sensor assemblies secured to the teeth.
Figure 8:
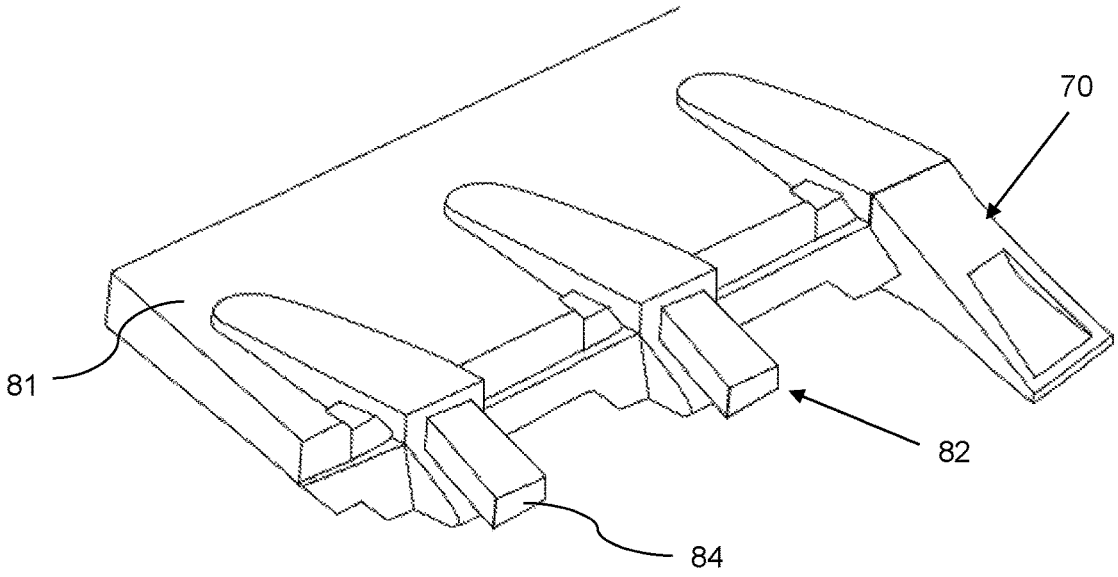
FIG. 8 is a front elevation of a bucket of a front end loader machine on which is mounted a plurality of teeth of the type depicted in FIGS. 4, 5 and 6.
Figure 9:
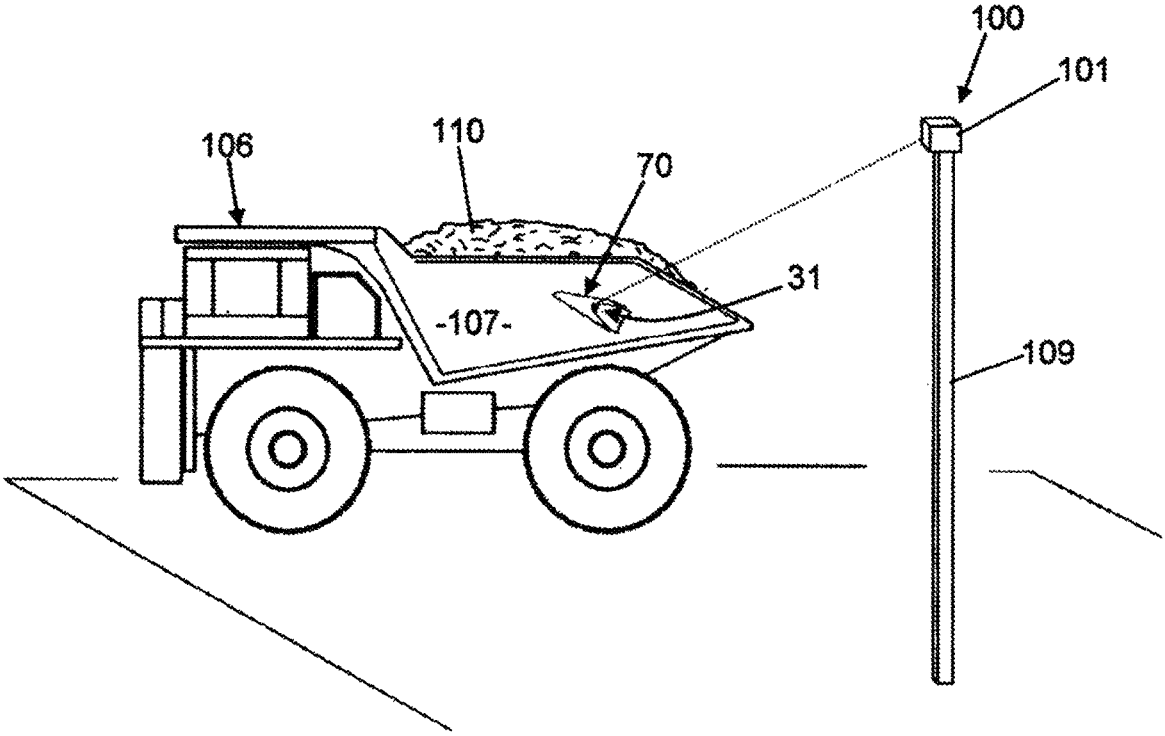
FIG. 9 depicts a post on which is mounted a fixed sensor assembly reader scanning the load of a haul truck which includes a tooth to which is secured a sensor assembly.

In a representative embodiment of the present disclosure, the sensor assembly 31 is adapted to fit into a recess 76 in a wear component 32 on machine 33. A ground engaging tool (GET) or wear component 32 which is in the form of a replaceable tooth/point 70 for a bucket or scoop is depicted in FIGS. 5, 6 and 7 of the drawings. Tooth 70 has a generally tapered profile and includes an upper side 71, a lower side 72, a leading end 73, and a trailing end 74. A cavity 75 for receiving a projection of an adaptor 82 (as shown in FIGS. 8 and 9 of the drawings) that is secured to the bucket or scoop extends into the tooth 70 from the trailing end 74.

A cylindrical recess/hole 76 is created in the tooth 70 at a base 77 of the cavity 75. The recess 76 may, for example, be created in the tooth 70 by casting, boring, drilling, or milling it into the tooth 70 which is made out of metal, typically high-strength steel. The diameter of the recess 76 is slightly larger than the outer diameter of the cylindrical housing 40 so that the housing 40 is able to be inserted into the recess 76. The depth of the recess 76 is such that the sensor assembly 31 is able to be inserted into the recess 76 such that the sensor assembly 31 (including the cylindrical housing 40) does not protrude from the recess 76.

An adhesive agent such as, for example, a silicone sealant which is located between the bottom of the recess 76 and the inner end of the cylindrical housing 40 which includes the lid 44, secures the sensor assembly 31 to the tooth 70 so that the sensor assembly 31 is retained in place relative to the tooth 70. This adhesive agent may be in addition to, or as an alternative to, the silicone rubber layer 49 that is adhered or bonded to a bottom surface of the lid 42. Inserting the sensor assembly 31 into the recess 76 in this manner assists in protecting the housing 40, and exposes the base 48 of the cup 41 to the wear face/base 77 of the recess 76 (proximate the adapter 82 when the tooth 70 is brought into engagement with the adapter 82).

The positioning of the sensor assembly 31 within a recess/hole 76 in a centralised location within the tooth 70 is of significance, as will be explained in further detail below. In addition to providing protection of the sensor assembly 31, this centralised location is beneficial for detecting an average temperature indication of the thermal mass of the tooth 70. This temperature indication being provided by the temperature sensor, being one of the electronic components 53 contained within the sensor assembly 31.

In accordance with a representative embodiment of the present disclosure, it is important to appreciate the spatial relationship between the sensor assembly 31 elements, particularly the sensor to metal disc antenna gap 58 that exists between the sensor component 51 (particularly the electronic components 53 on the circuit board 52) and the metal disc antenna 54, as well as the metal disc antenna to outer casing gap (not shown) that exists between the metal disc antenna 54 and the cup 41 of the cylindrical housing 40 (when the cup 41 and lid 42 of the cylindrical housing 40 are brought into engagement).

The active RF transmission components 53 of the sensor component 51 are arranged on the circuit board 52 "ground plane" and the impedance matched assembly stack and resulting radiating pattern from the metal disc antenna 54 is tuned to the wear component 32. In this RF assembly, the sensor assembly 31 is tuned to a metal structure (i.e. the GET wear component 32). Ordinarily, a metal structure of this sort would act as a 'Faraday Cage', although the tuning of the antenna 54 to the wear component 32 enables the system 30 to exploit the surrounding steel and make it operate as an antenna (i.e. an extension of the metal disc antenna 54). As a result, the assembled GET wear component 32 amplifies the RF signal (generated by the metal disc antenna 54) by acting as a larger antenna and enabling the data transmitted from the sensor component 51 to be received by a remote radio frequency receiver 90. A key aspect to the coupling of the antenna 54 to the wear component 32 is the preservation of the sensor to metal disc antenna gap 58 and metal disc antenna to outer casing gap (not shown).

Preservation of the sensor to metal disc antenna gap 58 is an important attribute of coupling (an RF design term referring to an undesirable state), allowing the ordinary 'Faraday Cage' effect of the metal wear component 32 (e.g. a tooth of a GET) on the antenna 54 to instead behave as an extension of that antenna 54 and enable data transmitted from the sensor component 51 to be received by the remote radio frequency receiver 90.

As described above, the metal disc antenna 54 and the metal connector element 55 are integrally formed such that the metal disc antenna 54 is resiliently retained at a predetermined distance above the circuit board 52 of the sensor component 51 without the need for additional apparatus.

In its resting state or configuration, the sensor assembly 31 prior to the application of an impact force to the sensor assembly 31 or outer casing 40, the metal disc antenna 54 is resiliently retained at a predetermined distance above the circuit board 52 of the sensor component 51. This configuration is preferred to a fixed configuration, since the large impact forces commonly associated with operation of the machine 33 may otherwise cause a permanently attached metal disc antenna to deflect or detach from the sensor component51, causing the metal disc antenna to, for example, collapse on the circuit board 52 and reduce performance. As such, it is desirous that the metal connector element 55 have some resilient properties, allowing the metal disc antenna 54 to return to its original position upon removal of a "normal to in-use" impact force. Impact loads in some environments may be brief, measured in milliseconds, but significant in magnitude with average G-Forces up to 8 g, but sometimes even greater force.

The sensor to metal disc antenna gap 58 that exists between the circuit board 52 and the metal disc antenna 54, as well as the metal disc antenna to outer casing gap (not shown) that exists between the metal disc antenna 54 and the cup 41 of the cylindrical housing 40 are preferably air gaps. The use of an air gap, or alternatively a potting material, is preferable as it allows the sensor assembly 31 to operate well in a wide range of operating temperatures (e.g. −40 to +170 Degrees Celsius). Similarly, sensors and electronic components 53 in the sensor component 51 should be selected to ensure they are capable of operating in the typical operating temperature range of GET wear components.

Referring to FIGS. 7 and 8 of the drawings, a mining/earthmoving machine 33 in the form of a front end loader 80 includes a ground engaging tool in the form of a bucket 81. A plurality of adapters 82 are mounted on a bottom lip 83 of the bucket 81, and a respective tooth 70 is secured to each adapter 82 in the usual manner. Each adapter 82 includes a projection 84 that is inserted into the cavity 75 of a respective tooth 70 such that at the interface of each projection 84 and tooth 70 there is sufficient clearance between the projection 84 and the sensor assembly 31.

Once embedded within the recess 76 of the wear component 32, the sensor assembly 31 (including, particularly, the metal disc antenna 54) may be fine tuned to use the surrounding metal (of the wear component 32) as an amplifier or at least an extension of that antenna 54.

Preferred frequencies, and/or ranges for amplification, for the antenna 54 are ideally within the Ultra High Frequency (UHF) range, although it should be appreciated that other frequencies and frequency ranges may be preferred depending on the application and/or the type of wear components 32 within with the sensor assembly 31 is located.

The sensor system 30 further comprises a remote radio frequency receiver 90 operable to receive sensor data wirelessly from the sensor component 51, transmitted to the remote radio frequency receiver 90 via the metal disc antenna 54. In a representative embodiment of the present disclosure, the remote radio frequency receiver 90 is mounted on the front end loader 80. The remote radio frequency receiver 90 preferably includes an antenna (or plurality of antennas, not shown) that are mounted on a suitable position on the front end loader 80 such as, for example, the top of a cab 92 of the front end loader 80. The antenna (not shown) allows the remote radio frequency receiver 90 to communicate with the sensor assemblies 31. In particular, it allows the remote radio frequency receiver 90 to detect/read sensor assemblies 31 that are within the range of the remote radio frequency receiver 90.

Referring again to FIG. 1 of the drawings, the remote radio frequency receiver 90 is connected to a Wi-Fi transceiver 93. The remote radio frequency receiver 90 and the transceiver 93 are connected to each other so that they can communicate with each other. The reader 90 is able to transmit data to the transceiver 93. For example, the reader 90 is able to transmit to the transceiver 93 sensor data which the reader 90 reads from the sensor assembly 31. A transceiver antenna 94 is connected to the transceiver 93 so that the transceiver 93 is able to communicate with a wireless communication network such as a Wi-Fi communication network 95 of the sensor system 30. The transceiver 93 is able to transmit the data (e.g. sensor data of the sensor assembly 31) that is transmitted to it by the remote radio frequency receiver 90 to the network 95.

If the machine 33 (e.g. front end loader 80) includes a plurality of wear components 32 (such as shown in FIGS. 7 and 8 of the drawings with the front end loader 80) that each includes their own sensor assembly 31, the remote radio frequency receiver 90 reads the data of each of the sensor assemblies 31.

An Ethernet switch 96 is preferably connected to the remote radio frequency receiver 90 and the transceiver 93.

The remote radio frequency receiver 90 and the transceiver 93 are connected to the switch 96 such that they are able to communicate with each other through/via the switch 96. The transceiver 93 and the switch 96 are preferably part of a mining communication backbone. The remote radio frequency receiver 90, associated antenna (not shown), transceiver 93, transceiver antenna 94, and switch 96 function as a machine mounted sensor assembly reading station 97 of the sensor system 30. The sensor system 30 can include multiple machine mounted sensor assembly reading stations 97. For example, the sensor system 30 can include multiple machine mounted sensor assembly reading stations 97, with each station 97 being mounted on a respective machine 33.

In an alternative embodiment of the present disclosure, the radio frequency receiver 90 may be configured with onboard computer processing capability (such as, for example, the embedded personal computer 160 shown in the drawings) such that it can directly process sensor data received wirelessly from the sensor component 51, transmitted to the remote radio frequency receiver 90 via the metal disc antenna 54.

Referring again to FIG. 1, the sensor system 30 also includes one or more fixed position sensor reading stations 100. Each station 100 includes a sensor assembly reader 101, a Wi-Fi transceiver 102, and an antenna 103. The reader 101 and the transceiver 102 are connected to each other so that they can communicate with each other. The reader 101 is able to transmit data to the transceiver 102. For example, the reader 101 is able to transmit to the transceiver 102 sensor data (and material wear characteristics) which the reader 101 reads from the sensor assembly 31. The antenna 103 is connected to the transceiver 102 so that the transceiver 102 is able to communicate with the network 95. The transceiver 102 is able to transmit the data (e.g. sensor data and material wear characteristics of the wear component 32) that is transmitted to it by the reader 101 to the network 95.

A fixed position sensor reading station 100 is shown in FIG. 9 mounted to an overhead framework (not shown) of a crusher hopper (not shown). The reader 101 of the station 100 is positioned so that it can scan haul trucks such as a haul truck 106. In particular, the reader 101 is positioned so that it can scan the load in a tray 107 of the haul truck 106 to determine whether or not there are any sensor assemblies 31 in the load before, during and after the truck 106, deposits its ore load 110 in the crusher hopper (not shown). If the reader 101 detects a sensor assembly 31 in the load of the truck 106, then it is likely that the wear component 32 that the sensor assembly 31 is secured to is also in the load. Once the sensor assembly 31 has been detected in the load, the load can be deposited elsewhere, or the wear component 32 can be removed from the load prior to depositing the load in the crusher (not shown) so as to prevent the crusher (not shown) from being damaged by the wear component 32.

The sensor assembly reader 101 of the fixed position sensor reading station 100 depicted in FIG. 9 includes an antenna 108 that allows the reader 101 to communicate with the sensor assemblies 31. In particular, the antenna 108 enables the reader 101 to detect/read sensor assemblies 31 that are within the range of the reader 101.

In an alternative embodiment of the present disclosure, a sensor assembly reader 101 of a fixed position sensor reading station 100 is mounted on a post 109. The reader 101 is positioned so that it is able to detect the presence of/read a sensor assembly 31 while in operation on a front end loader 80 (or similar excavating machine). The sensor assembly 31 is secured to a tooth 70 on a bucket 81 of an operational front end loader 80, enabling detection/reading of the sensor assembly 31 by the reader 101. More specifically, reading of the sensor data (including the material wear characteristics of the wear components 32) can be performed while the front end loader 80 is operational.

Referring again to FIG. 1, the sensor system 30 also includes one or more handheld reader units 120. Each unit 120 is adapted to be carried by a respective person. Each unit 120 includes a sensor assembly reader 121, a Wi-Fi transceiver 122, and an antenna 123. The reader 121 and the transceiver 122 are connected to each other so that they can communicate with each other. The reader 121 is able to transmit data to the transceiver 122. For example, the reader 121 is able to transmit to the transceiver 122 sensor data which the reader 121 reads from the sensor assembly 31. An antenna 123 is connected to the transceiver 122 so that the transceiver 122 is able to communicate with the network 95. The transceiver 122 is able to transmit the data (e.g. sensor data of the sensor assembly 31) that is transmitted to it by the reader 121 to the network 95.

Although not depicted in the drawings, the reader 121 includes one or more antenna that allow the reader 121 to communicate with the sensor assemblies 31. In particular, the antenna of the reader 121 allow the reader to detect/read sensor assemblies 31 that are within the range of the reader 21. Each sensor assembly 31 has its own unique sensor assembly identification data (e.g. a unique sensor identification number) so that the readers 90, 101, 121 are able to identify the individual sensor assemblies 31. When a sensor assembly reading station 97, 100, 120 is used to detect the loss of the component 32 from the machine 33, or to detect recovery of the component 32 if it is lost, the sensor assembly reading station attempts to read the sensor assembly 31 and obtain the sensor assembly identification data for the sensor assembly 31.

The sensor system 30 also includes a monitoring station 130 that includes a Wi-Fi transceiver 131, an antenna 132, and a server 133. The antenna 132 is connected to the transceiver 131 so that the transceiver 131 is able to communicate with the other transceivers 93, 102, 122 and therefore the readers 90, 101, 121 via the network 95. For example, the transceiver 131 is able to receive from the transceivers 93, 102, 122 via the network 95 the sensor data and material wear characteristics which the readers 90, 101, 121 read from the sensor assembly 31. The transceiver 131 is connected to the server 133 so that they are able to communicate with each other. The transceiver 131 is able to transmit the data (e.g. sensor data and material wear characteristics of the sensor assembly 31) that it receives from the transceivers 93, 102, 122 via the network 95 to the server 133 so that the server 133 can then process the data.

Server 133 includes a processor 134, memory 135, and a database 136. Software which is stored on the memory 135 is run on the processor 134 of the server 133, which is a central server. The server 133 communicates with the readers 90, 101, 121 via the wireless network 95 and stores all data in the database 136.

The server 133 is able to generate alarm messages/issue alerts which can be communicated to users via a number of different methods, and the system in general or the server 133 in particular interfaces to existing mine management software using a data communication link. For example, if the system 30 via the server 133 detects that a tooth 70 to which a sensor assembly 31 is secured has fallen off the machine 33, this will generate an alarm message which will then be communicated to a user (e.g. the operator of the machine 33) by a suitable method (e.g. by radio) so that the user or someone else can take appropriate action to prevent the tooth 70 from finding its way into the crusher. The server 133 can be a standalone physical machine, or a virtual server as provided by the mine operator to utilise their existing infrastructure.

It has been found that the sensor assembly 31 can be detected/read consistently over a distance of 50 metres from any direction while embedded in the tooth 70. Further, it has been found that when the tooth 70 is fitted to the adapter 82, thereby shielding the sensor assembly 31 from any direct path to a reader such as the reader 90, 101 , or 121, the signal strength increases as a result of the coupling effect with the wear component 32. This result means that it is possible to detect/read the sensor assemblies 31 of a working machine 33 for active monitoring of their status (i.e. when they are attached to the machine 33). It is possible to remotely log into the sensor system 30 and view all of the sensor assemblies 31 that are mounted on the wear components 32 of the machine 33 while it is operating in a mining pit.

Figure 10:
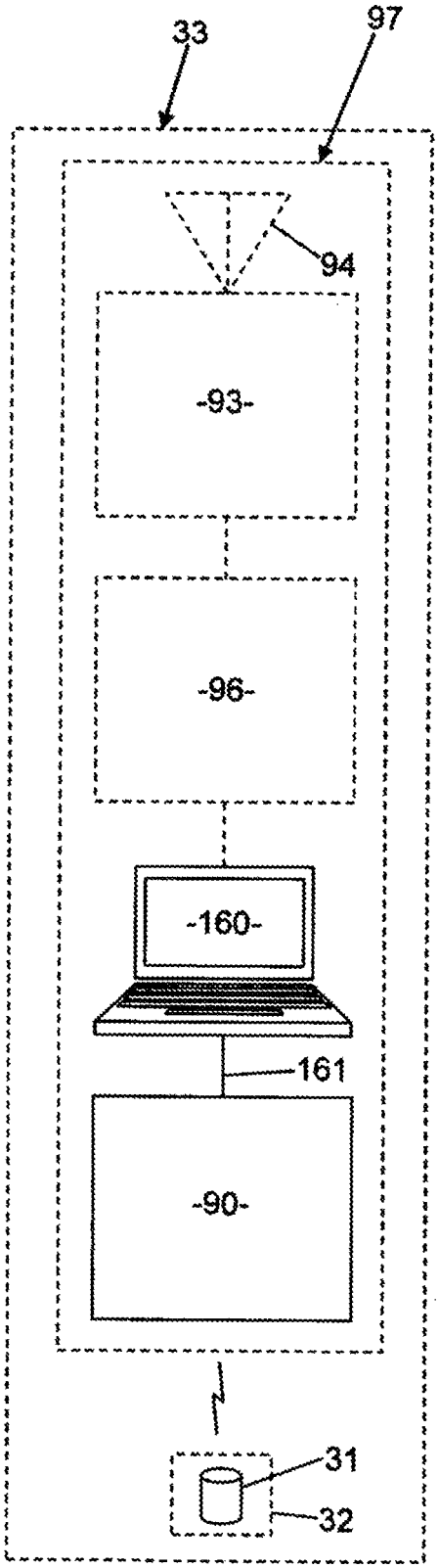
FIG. 10 is a schematic diagram depicting a machine that has a first alternative machine mounted sensor assembly reading station.

Referring to FIG. 10, in an alternative form the present disclosure, the machine mounted sensor assembly reading station 97 can include a stand-alone, rugged, embedded personal computer 160 that is mounted in a cab of the machine 33. Computer 160 is connected to the sensor assembly reader 90 via a data communication link 161 such that the computer 160 is able to communicate with the reader 90. The computer 160 functions in a similar manner to the server 133 in that it is able to process all of the information/data provided by the reader 90. However, unlike the server 133, the computer 160 is obviously located locally with the reader 90. The computer 160 is able to alert/issue an alert to the operator of the machine 33 via local alarms/buzzers should the reader 90 detect the loss of a wear component 32 from the machine 33 or the wearing of a wear component 32 beyond certain predetermined safe wear limits. In this way, the station 97 is able to act as an independent or self-contained monitoring system which does not need to communicate with the monitoring station 130 and therefore does not necessarily require the transceiver 93, antenna 94, and switch 96. However, the station 97 may still include the transceiver 93, antenna 94, and switch 96 so that the reader 90 is able to communicate with the server 133 via the computer 160.

This embedded computer option can provide a detection system for mines which do not have reliable Wi-Fi infrastructure to transmit the reader data across, or for mines that may want local processing of alarms on the machine 33 and also on the backbone server 133 to provide site-wide monitoring of multiple machines 33.

Figure 11:
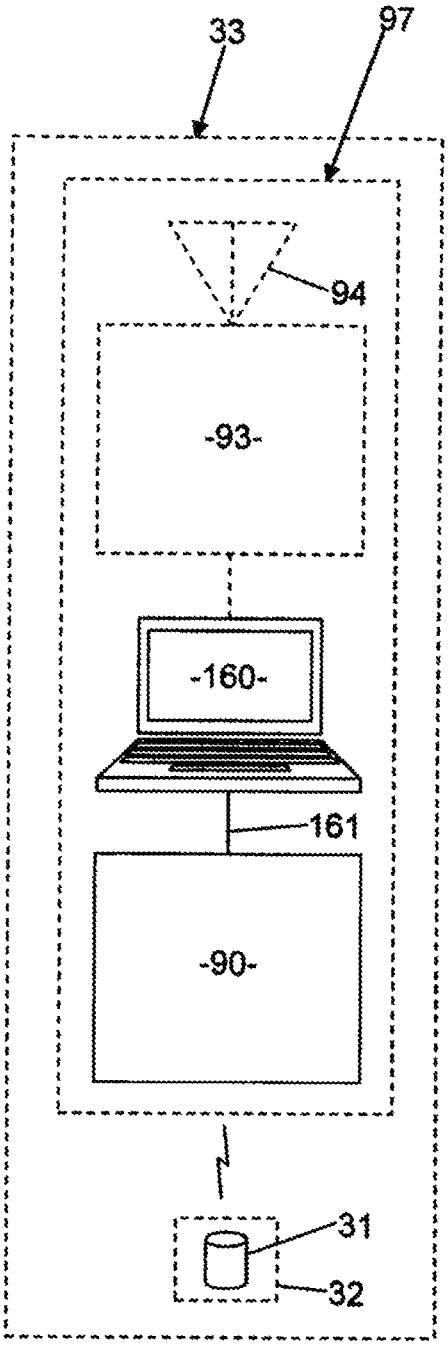
FIG. 11 is a schematic diagram depicting a machine that has a second alternative machine mounted sensor assembly reading station.

Referring to FIG. 11, another alternative form of the machine mounted sensor assembly reading station 97 is similar to the station depicted in FIG. 10 except that it does not include an Ethernet switch 96, and the computer 160 is connected directly to the transceiver 93 so that the computer 160 and transceiver 93 are able to communicate directly with each other.

Figure 12:
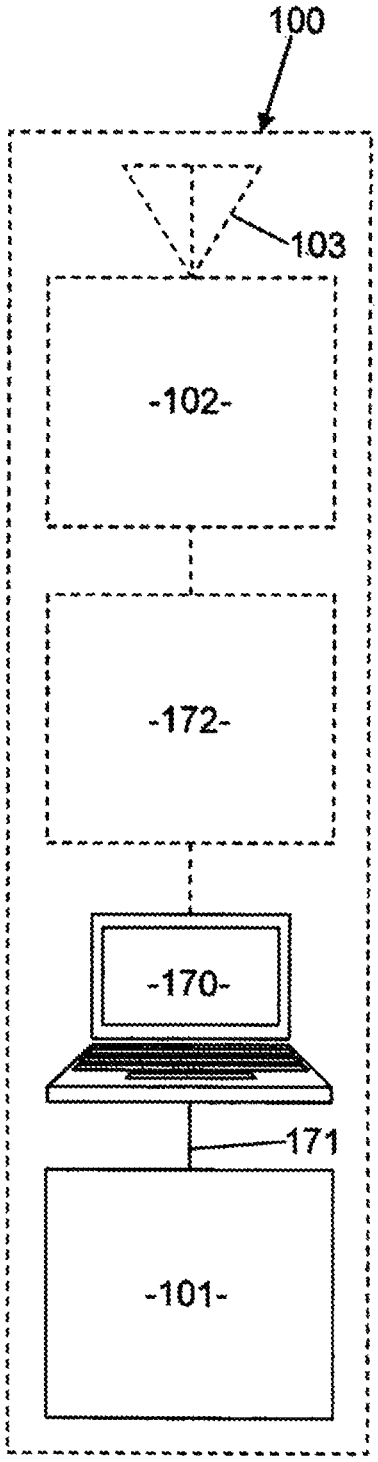
FIG. 12 is a schematic diagram depicting a first alternative fixed position sensor assembly reading station.
Figure 13:
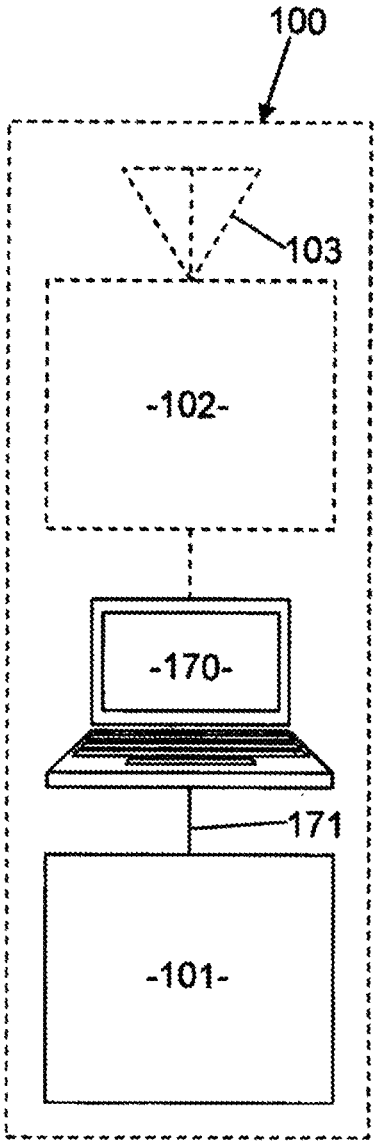
FIG. 13 is a schematic diagram depicting a second alternative fixed position sensor assembly reading station.

Similarly to the machine mounted sensor assembly reading station depicted in FIG. 10, the fixed position sensor assembly reading station 100 can include a stand-alone, rugged, embedded personal computer 170 as shown in FIGS. 12 and 13. Computer 170 is connected to the sensor assembly reader 101 of the station 100 via a data communication link 171 such that the computer 170 is able to communicate with the reader 101. The station 100 may also include an Ethernet switch 172 as depicted in FIG. 12 with the computer 170 being connected to the switch 172 and the switch 172 being connected to the transceiver 102 of the station 100 such that the computer 170 and the transceiver 02 are able to communicate with each other via the switch 172. Alternatively, the computer 170 may be connected directly to the transceiver 102 as shown in FIG. 13 so that the computer 170 and the transceiver 102 are able to communicate directly with each other.

The computer 170 functions in a similar manner to the server 133 in that it is able to process all of the information provided by the reader 101. The computer 170 is able to issue an alert to an operator via local alarms buzzers should the reader 101 detect a lost component 32 or the wearing of a wear component 32 beyond certain predetermined safe wear limits. In this way, the station 100 is able to act as an independent or self-contained detection system which does not need to communicate with the monitoring station 130 and therefore does not necessarily require the transceiver 102, antenna 103, and switch 172 (in the case of the station 100 depicted in FIG. 12). However, the station 100 may still include the transceiver 102, antenna 103, and switch 172 (in the case of the station 100 depicted in FIG. 12) so that the reader 101 is able to communicate with the server 33 via the computer 170.

The handheld reader units 120 are preferably handheld units that are able to write data to user memory of a sensor assembly 31, read data from a user memory of a sensor assembly 31, change the sensor assembly status of a sensor assembly 31 from inactive (dormant) to active (beaconing), and vice versa; and/or locate a lost component 32 to which a sensor assembly 31 is secured. Each of the sensor assemblies 31 of the sensor system 30 is typically inactive from the time it is transported from the factory where it is made/manufactured to the time it is delivered to the end user/customer. When a sensor assembly 31 is inactive it is in a dormant state so that it does not beacon out/transmit a full strength radio signal. Placing a sensor assembly 31 in a dormant state allows the sensor assembly's battery to be conserved so as to thereby maximise the service life of the sensor assembly 31.

Figure 14:
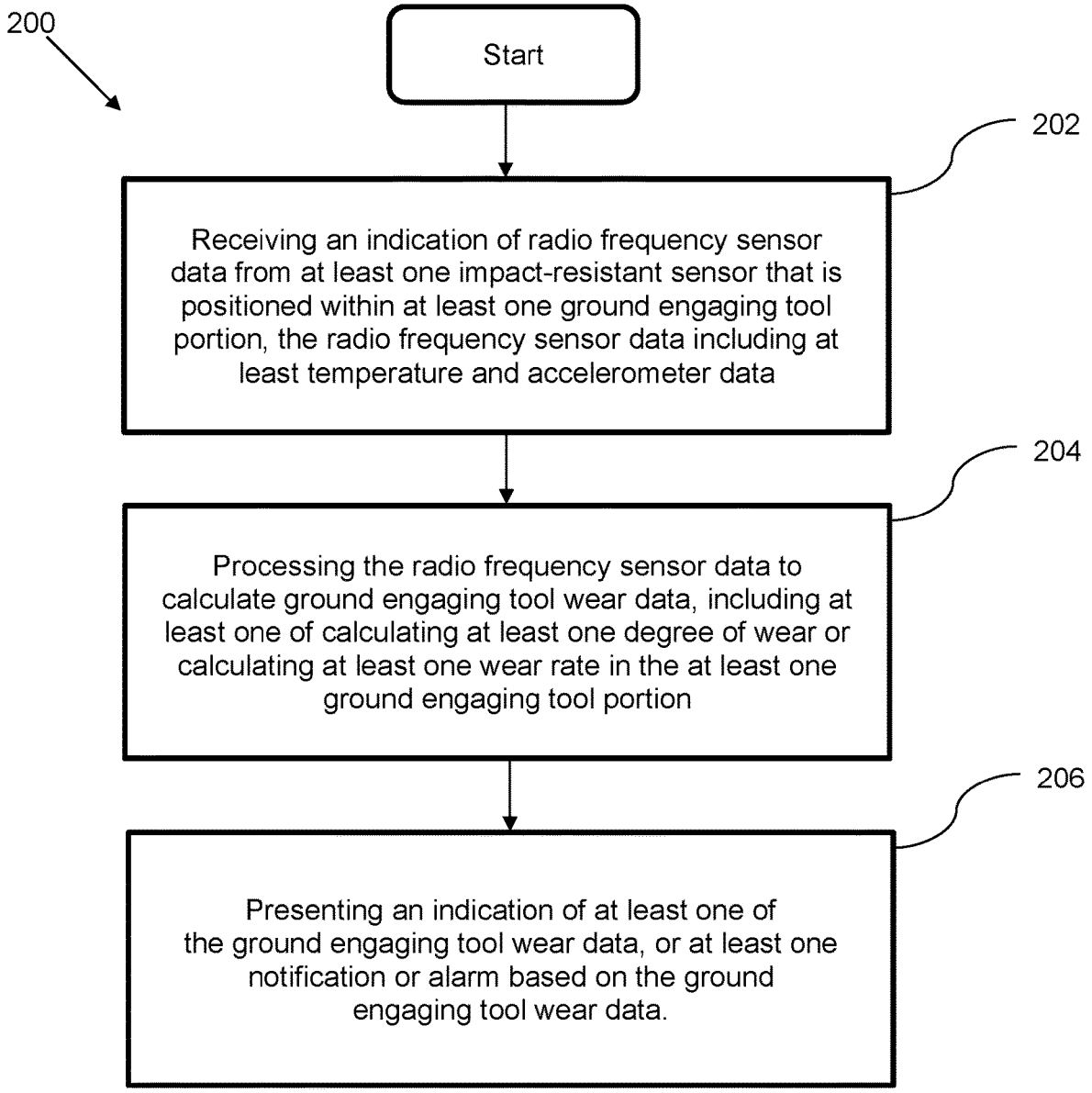
FIG. 14 is a flow diagram illustrating a ground engaging tool condition monitoring method in accordance with a representative embodiment of the present disclosure.

In summary, a ground engaging tool condition monitoring method and apparatus has been developed and disclosed herein. As shown at FIG. 14 of the drawings, the method 200 includes at step 202 receiving an indication of radio frequency sensor data from at least one impact-resistant sensor 31 that is positioned within at least one ground engaging tool portion 32, the radio frequency sensor data including at least temperature and accelerometer data.

Step 204 includes processing the radio frequency sensor data to calculate ground engaging tool wear data, including at least one of calculating at least one degree of wear or calculating at least one wear rate in the at least one ground engaging tool portion 32. The at least one degree of wear indicates at least one of a desired state of wear or an undesirable state of wear. More preferably, the at least one degree of wear indicates a temperature rate of rise (RoR) indicative of a worn ground engaging tool (i.e. wear component 32) performance. The step 204 of processing the radio frequency sensor data to calculate ground engaging tool wear data includes determining a rate of rise of the ground engaging tool based at least in part on the temperature data.

In an alternative embodiment of the present disclosure, the step 204 of processing the radio frequency sensor data to calculate ground engaging tool wear data includes determining a rate of rise of the ground engaging tool based on both the temperature data and accelerometer data.

In a representative embodiment of the present disclosure, the method 200 further comprises sending radio frequency sensor data from the at least one impact-resistant sensor that is positioned within the at least one ground engaging tool portion 32, the radio frequency sensor data including at least temperature and accelerometer data, to a receiver 90. In determining the temperature RoR, at least one temperature sensor (not shown) on the circuit board 52 of the sensor component 51 is able to detect variations in one or more thermal properties of a wear component 32 that the sensor assembly 31 is embedded within. As stated above, the positioning of the sensor assembly 31 within a recess/hole 76 in a centralised location within the tooth 70 is of significance as it enables the at least one temperature sensor (not shown) to obtain an average temperature indication of the thermal mass of the tooth 70. As a person skilled in the art will appreciate, the temperature of a tooth 70 during digging operations can vary significantly at different areas of the tooth 70. For example, the tip (not shown) of the tooth 70 that directly engages the earth may have a significantly higher temperature (or average temperature) than areas of the tooth that merely engage with the adapter 82. However, a centralised location at, for example, at the base 77 of the cavity 75 is advantageous in that it naturally provides an average temperature for the thermal mass of the tooth 70.

One or more thermal properties of the wear component 32 are used to infer the degree of wear of the wear component 32 within which the sensor assembly 31 is embedded. Further, one or more thermal properties of the wear component 32 are used to infer a percentage wear rate of the wear component 32. For example, as a wear component 32 gradually wears the expected temperature RoR for that wear component 32 (as measured by a temperature sensor within the electronic components 53 of the sensor assembly 31) predictably increases, allowing for an inference to be made about the percentage wearing of the wear component 32.

Additionally, the accelerometer data is preferably combined with the one or more thermal properties of the wear component 32 and used to infer a percentage wear rate of the wear component 32. For example, in a representative embodiment of the present disclosure, accelerometer data is used to count the number of scoops of the bucket 81 from the time of attachment of a new tooth 70 (with embedded sensor assembly 31). Wear of the tooth 70 can then be estimated by using the detected number of bucket scoops (active digging cycles) as a simple linear calculation (that is, a linear relationship between the number of bucket scoops, up to an expected maximum e.g. 40,000 scoops, being directly related to the wearing of the tooth 70 from 0 to 100%).

In a particularly preferred embodiment of the present disclosure, the measured temperature rate of rise (RoR) (and/or temperature rate of fall, or temperature rate of change) data and applying the delta of this temperature RoR data and a weighting applied to the accelerometer data (depending on the measured number of scoops, or active digging cycles) such that an increasing temperature RoR advances the linear wear calculation. For example, it may be feasible that 100% wear of the tooth 70 is reached after 25,000 scoops with a particularly high wear rate, but this will be reflected by a higher temperature RoR (and/or temperature rate of fall, or temperature rate of change) as reflected in the temperature RoR data.

Figure 15:
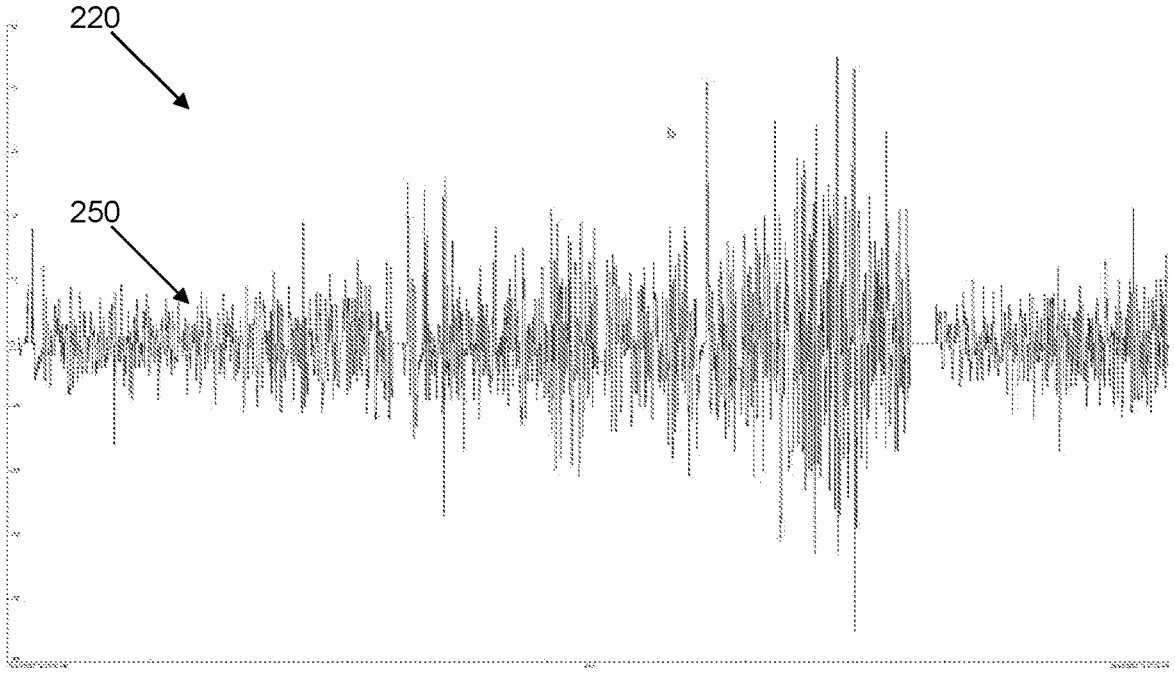
FIGS. 15 and 16 are graphs depicting temperature rate of rise (RoR) data transmitted by a sensor assembly for a wear component over a predetermined period of time.
Figure 16:
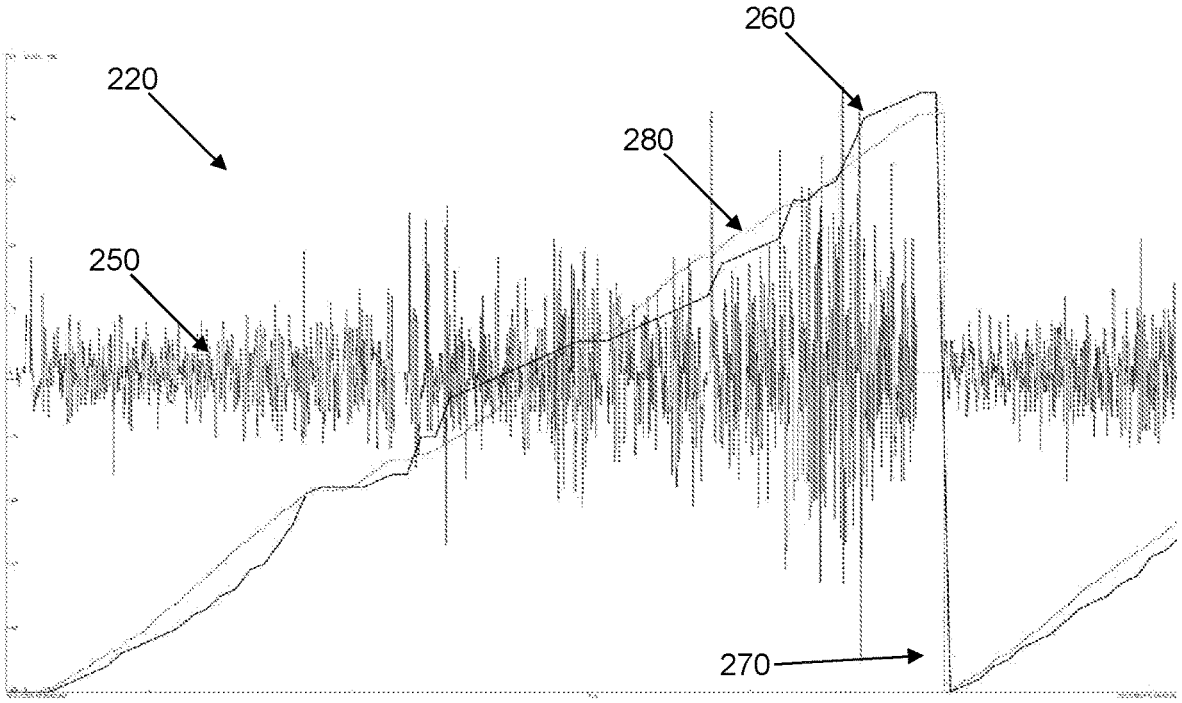

FIGS. 15 and 16 shows an example of temperature RoR data 250 for a sensor assembly 31 within a wear component 32 on a machine 33. The graphs 220 (showing rate of rise on the Y-axis and time in days on the X-axis) indicate an example of temperature RoR data and the calculated percentage wear 260 of the wear component 32 over a period of 41 days, although it can be seen that the wear component is replaced 270 after 30 days after reaching a 94% wear. Also illustrated is the number of scoops (active digging cycles) 280 for the wear component 32 recorded as part of the accelerometer data (showing 22,674 scoop cycles at the replacement 270 of the wear component 32).

When the RoR correlates to an undesirable degree of wear, a preventative maintenance alert can be signaled prior to failure of the wear component 32. Alternatively, if use continues beyond the degree of wear indicative of a worn ground engaging tool performance, an exposed sensor assembly 31 revealed by the wear, may be destroyed by an impact and cease to emit. This cessation of the signal from the sensor system may trigger an alert. Alternatively, the exposure of the sensor assembly 31 may be the impetus for an alert to be triggered once the RoR has been received by the remote radio frequency receiver 90.

Step 206 comprises presenting an indication of at least one of the ground engaging tool wear data, or at least one notification or alarm based on the ground engaging tool wear data. In a representative embodiment of the present disclosure, the alert is electronically communicative with the remote receiver 90, and may include one or more of an audible alarm, a visual alert (such as, for example, a blinking light, a displayed alert on a LCD monitor, a displayed alert on a wearable device, a displayed alert on a LED monitor, or a displayed alert on a OLED monitor), a user detectable alert and/or machine detectable alert when the inferred degree of wear of the wear component 32 is an unacceptable degree of wear (i.e. when the wearing of a wear component 32 exceeds or approaches certain predetermined safe wear limits e.g. 90-100% wearing of wear component 32). The machine detectable alert may also include a stop instruction for disarming an operation of a mechanical device such as, for example, the machine 33 or the operation of the wear component 32.

In accordance with an alternative embodiment of the present disclosure, a piezo microphone (not shown) may combined with temperature RoR to infer wear of the wear component 32 and trigger alerts to the remote receiver 90. As wearing of the wear component 32 occurs, the reduction in steel increases the acoustic resonant frequency of the wear component 32. Detection of the reduction in steel mass around the sensor assembly 31 could therefore be detected from the acoustic properties of a suitable sensor assembly 31 including a piezo microphone (not shown) within the electronic components 53 of the sensor component 51.

Figure 17:
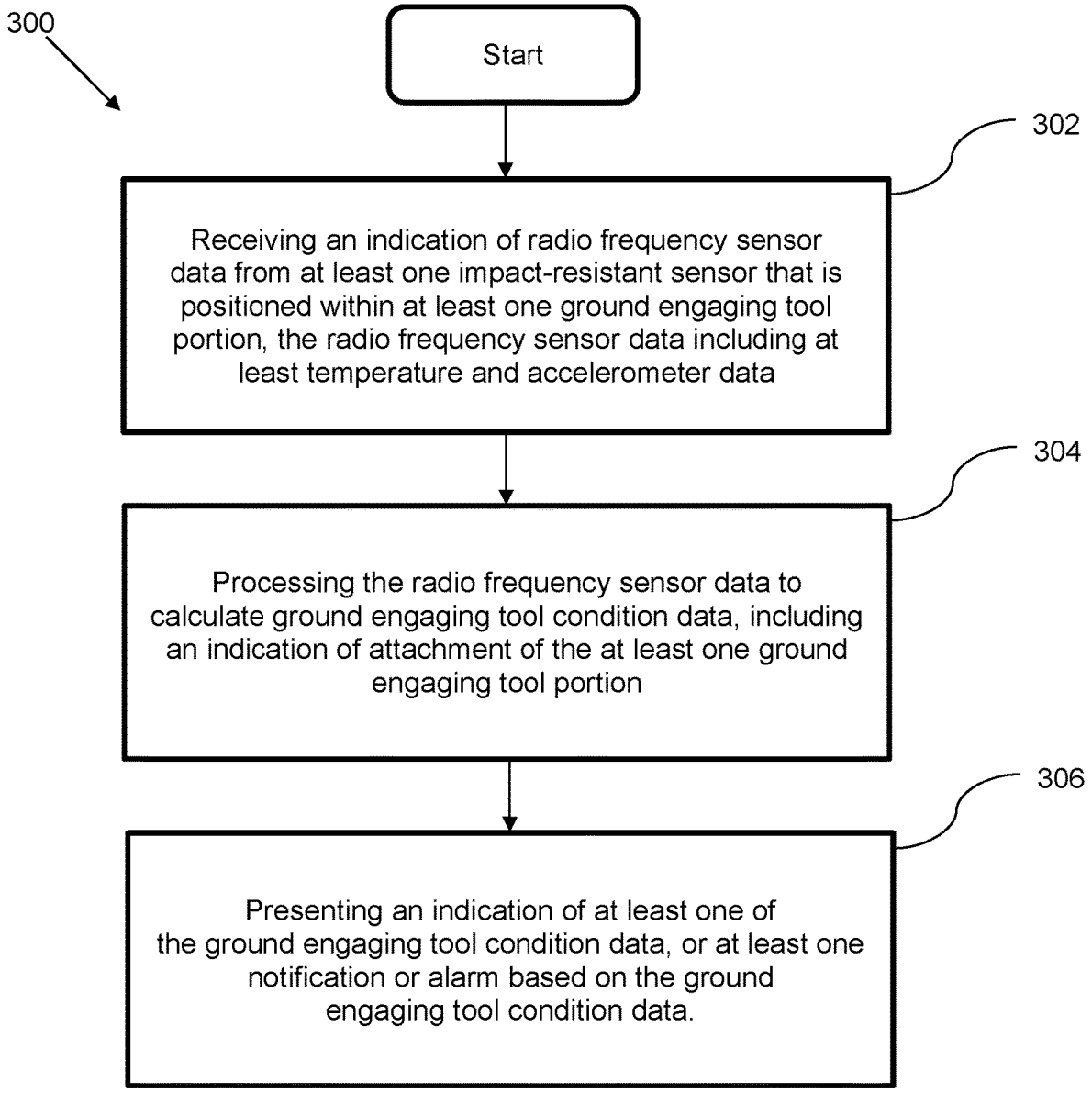
FIG. 17 is a flow diagram illustrating a ground engaging tool condition monitoring method in accordance with an alternative embodiment of the present disclosure.

As shown at FIG. 17 of the drawings, the method 300 includes at step 302 receiving an indication of radio frequency sensor data from at least one impact-resistant sensor 31 that is positioned within at least one ground engaging tool portion 32, the radio frequency sensor data including at least accelerometer data.

Step 304 includes processing the radio frequency sensor data to calculate ground engaging tool condition data, including an indication of attachment of the ground engaging tool portion 32. In a representative embodiment of the present disclosure, the method 300 further comprises sending radio frequency sensor data from the at least one impact-resistant sensor 31 that is positioned within the at least one ground engaging tool portion 32, the radio frequency sensor data including at least accelerometer data, to a receiver 90. Calculation of the ground engaging tool condition data (including, specifically, an indication of attachment of the ground engaging tool portion 32) is performed by monitoring at the remote receiver 90 whether ground engaging tool condition data is still being received from the impact-resistant sensor 31 within the ground engaging tool portion 32 and/or determining from the accelerometer data whether the ground engaging tool portion 32 (and embedded sensor 31) is still moving in accordance with the movement of the bucket 81 of the front end loader 80. The movement of the bucket 81 (i.e. active digging cycles) is preferably obtained from accelerometer data from a separate accelerometer (not shown) positioned on the bucket 81.

Step 206 comprises presenting an indication of at least one of the ground engaging tool condition data, or at least one notification or alarm based on the ground engaging tool condition data. In a representative embodiment of the present disclosure, the alert is electronically communicative with the remote receiver 90, and may include more or more of an audible alarm, a visual alert (such as, for example, a blinking light, a displayed alert on a LCD monitor, a displayed alert on a wearable device, a displayed alert on a LED monitor, or a displayed alert on a OLED monitor), a user detectable alert (wherein the user detectable alert is triggered when the remote receiver 90 fails to receive ground engaging tool data from the sensor 31 within the wear component 32), and/or machine detectable alert when the accelerometer data does not correspond with the expected movement of the bucket 81 (preferably based on accelerometer data from a separate accelerometer (not shown) positioned on the bucket 81). The machine detectable alert may also include a stop instruction for disarming an operation of a mechanical device such as, for example, the machine 33 or the operation of the wear component 32.

As the present invention may be embodied in several forms without departing from the essential characteristics of the invention, it should be understood that the above described embodiments should not be considered to limit the present invention but rather should be construed broadly. Various modifications, improvements and equivalent arrangements will be readily apparent to those skilled in the art, and are intended to be included within the spirit and scope of the invention. The present embodiments are, therefore, to be considered in all respects as illustrative and not restrictive.

The invention claimed is:

1. A sensor system for monitoring the condition of a wear component comprising:

an outer casing;

at least one battery situated inside the outer casing;

at least one cushioning element interposed between the at least one battery and at least one sensor component;

at least one metal disc antenna positioned at a distance above the at least one sensor component;

at least one metal connector element configured to join the metal disc antenna to the sensor component; and wherein the outer casing is adapted to fit over and house at least the metal disc antenna, the cushioning element, the sensor component, and the metal connector.

2. The sensor system of claim 1 wherein the outer casing top portion is transparent to radio frequency electromagnetic signals.

3. The sensor system of claim 2 wherein the outer casing is comprised of plastic.

4. The sensor system of claim 3 wherein the outer casing is comprised of polyetherimide plastic.

5. The sensor system of claim 1 further comprising a silicone rubber layer on a bottom surface of the outer casing.

6. The sensor system of claim 1 wherein the at least one battery comprises a lithium cell battery.

7. The sensor system of claim 6 wherein the at least one battery comprises a lithium cell coin battery, wherein the diameter of the lithium cell coin battery is consistent with an inside diameter of the outer casing.

8. The sensor system of claim 1 wherein the at least one cushioning element is comprised of a low-density foam.

9. The sensor system of claim 1 wherein the at least one sensor component comprises at least one printed circuit board and at least one temperature sensor.

10. The sensor system of claim 1 wherein the at least one sensor component comprises at least one printed circuit board, at least one temperature sensor, and at least one accelerometer.

11. The sensor system of claim 1 wherein the at least one sensor component comprises at least one printed circuit board, at least one temperature sensor, and at least one MEMS accelerometer.

12. The sensor system of claim 1 wherein the at least one sensor component comprises at least one magnetometer.

13. The sensor system of claim 1 wherein the at least one sensor component comprises at least one capacitive sensor.

14. The sensor system of claim 1 wherein the at least one sensor component comprises at least one piezoelectric microphone.

15. The sensor system of claim 14 wherein the piezoelectric microphone comprises a MEMS piezo microphone.

16. The sensor system of claim 1 wherein the at least one metal connector element comprises an extension of a portion of the at least one metal disc antenna.

17. The sensor system of claim 1, further comprising a remote radio frequency receiver operable to receive sensor data wirelessly from the at least one sensor component.

18. The sensor system of claim 1, wherein the sensor system is adapted to fit into at least one recess in at least one ground engaging tool portion.

19. The sensor system of claim 18, wherein the at least one recess is positioned such that the recess is proximate to at least one adapter for supporting the at least one ground engaging tool portion when the at least one adapter and the at least one ground engaging tool are connected.

20. The sensor system of claim 18, wherein the at least one recess is positioned such that the recess opens into an internal cavity of the ground engaging tool portion, and such that the recess is centrally located within the ground engaging tool portion.

* * * * *